US010116026B2

(12) United States Patent
Shi et al.

(10) Patent No.: US 10,116,026 B2
(45) Date of Patent: Oct. 30, 2018

(54) COAXIAL FILTER HAVING FIRST TO FIFTH RESONATORS, WHERE THE FOURTH RESONATOR IS AN ELONGATED RESONATOR

(71) Applicant: COM DEV Ltd., Mississauga (CA)

(72) Inventors: Qiang Shi, Cambridge (CA); Ming Yu, Waterloo (CA)

(73) Assignee: COM DEV LTD., Mississauga (CA)

( * ) Notice: Subject to any disclaimer, the term of this patent is extended or adjusted under 35 U.S.C. 154(b) by 0 days.

(21) Appl. No.: 15/331,080

(22) Filed: Oct. 21, 2016

(65) Prior Publication Data

US 2017/0040656 A1 Feb. 9, 2017

Related U.S. Application Data

(62) Division of application No. 13/900,822, filed on May 23, 2013, now Pat. No. 9,509,031.

(51) Int. Cl.

| | |
|---|---|
| ***H01P 1/205*** | (2006.01) |
| ***H01P 1/202*** | (2006.01) |
| ***H01P 1/207*** | (2006.01) |

(52) U.S. Cl.

CPC ..... *H01P 1/2053* (2013.01); *H01P 1/202* (2013.01); *H01P 1/207* (2013.01)

(58) Field of Classification Search

CPC ..... H01P 1/2053; H01P 1/205; H01P 1/2084
USPC ..... 333/203
See application file for complete search history.

(56) References Cited

U.S. PATENT DOCUMENTS

| | | | |
|---|---|---|---|
| 4,623,857 | A | 11/1986 | Nishikawa et al. |
| 5,936,490 | A | 8/1999 | Hershtig |
| 7,777,593 | B2 | 8/2010 | Weitzenberger |
| 8,085,118 | B2 | 12/2011 | Yu et al. |
| 2007/0139142 | A1 | 6/2007 | Li et al. |
| 2008/0252399 | A1 | 10/2008 | Wiehler |

OTHER PUBLICATIONS

Extended European Search Report dated Jan. 30, 2015 in corresponding EP Patent Application No. 14166086.0.
Non-final Office Action dated May 27, 2015 in corresponding U.S. Appl. No. 13/900,822 (now U.S. Pat. No. 9,509,031).
Examination Report dated Dec. 18, 2015 in corresponding EP Patent Application No. 14166086.0.
Non-final Office Action dated Feb. 18, 2016 in corresponding U.S. Appl. No. 13/900,822 (now U.S. Pat. No. 9,509,031).

*Primary Examiner* — Benny Lee
(74) *Attorney, Agent, or Firm* — Bereskin & Parr LLP/S.E.N.C.R.L., s.r.l.; Isis E. Caulder; T. Cameron Gale

(57) ABSTRACT

A microwave filter has a housing defining an inner cavity. A first resonator is positioned in a first portion of the inner cavity. A second resonator is positioned in a second portion of the inner cavity. A third resonator is positioned in a third portion of the inner cavity. The first resonator and the third resonator are cross-coupled via an iris. The second resonator is elongated and is coupled to the first resonator and the third resonator. The resulting microwave filter has a frequency response having a transmission zero in the lower stopband. A high-pass filter is realized without the use of a cross-coupling probe.

12 Claims, 19 Drawing Sheets

COAXIAL FILTER HAVING FIRST TO FIFTH RESONATORS, WHERE THE FOURTH RESONATOR IS AN ELONGATED RESONATOR

CROSS-REFERENCE TO RELATED APPLICATIONS

This application is a divisional of application Ser. No. 13/900,822, filed May 23, 2013 (now U.S. Pat. No. 9,509,031, issued Nov. 29, 2016), which is incorporated herein by reference.

FIELD

The present disclosure generally relates to the field of microwave filters. More specifically, the embodiments of the present disclosure relate to coaxial filter having at least one elongated resonator.

INTRODUCTION

A microwave filter is an electromagnetic device that can be tuned to pass energy within bands of frequencies (i.e. the passband) encompassing resonant frequencies of the filter, while substantially suppressing unwanted frequencies (i.e. the stopband).

Dielectric resonators, waveguide cavity resonators, and coaxial resonators are examples of types of microwave filters. Coaxial resonator filters use coaxial resonators which offer moderate quality factor, compact size and light weight. Coaxial resonator filters are attractive to many telecommunication applications.

U.S. Pat. No. 8,085,118 to Yu et al. discloses an inline microwave bandpass filter where cross coupling between non-adjacent resonators is realized by changing the orientation of selected resonators. The microwave bandpass filter includes a cavity and three or more resonators arranged in a row (or inline) in the cavity. At least one resonator has a different spatial orientation from at least one other resonator. For example, one or more of the resonators may be rotated 90 or 180 degrees with respect to one of the other resonators. This arrangement of resonators facilitates sequential coupling between pairs of adjacent resonators and cross coupling between at least one pair of non-adjacent resonators without the use of additional cross coupling structures such as dedicated coupling probes or extra cavities. One or more plates may be introduced between adjacent resonators to independently control the sequential and cross coupling.

In order to meet rejection requirements for communication systems, transmission zeros (TZs) on one or both sides of the passband are frequently requirements in microwave bandpass filter design. Transmission zeros are often realized by couplings between non-adjacent resonators, often referred to as cross couplings. The feedback of electromagnetic signal using either iris or probe causes a cancelation effect to form the TZs. Folded structures are often used to realize couplings between non-adjacent resonators. However, folded structures may not be always suitable where there are structural constraints that require input and output connectors on opposite sides of the two end resonators.

SUMMARY OF THE INVENTION

The present disclosure provides in one aspect a microwave filter having a housing defining an inner cavity. A first resonator is positioned in a first portion of the inner cavity.

A second resonator is positioned in a second portion of the inner cavity. A third resonator is positioned in a third portion of the inner cavity. The first resonator and the third resonator are cross-coupled. The second resonator is elongated and is coupled to the first resonator and the third resonator. The resulting microwave filter has a frequency response having a transmission zero in the lower stopband. A high-pass filter is realized without the use of a cross-coupling probe.

The present disclosure provides in another aspect a microwave filter having five resonators. A first resonator is positioned in a first portion of the inner cavity. A second resonator is positioned in a second portion of the inner cavity. A third resonator is positioned in a third portion of the inner cavity. A fourth resonator is positioned in a fourth portion of the inner cavity. A fifth resonator is positioned in a fifth portion of the inner cavity. The first resonator and the third resonator are cross-coupled. The second resonator is coupled to the first resonator and the third resonator. The third resonator is further cross-coupled to the fifth resonator. The fourth resonator is elongated and is coupled to the third resonator and the fifth resonator. The resulting microwave filter has a frequency response having a transmission zero in the lower stopband and a transmission zero in the upper stopband. A band-pass filter is realized without the use of a cross-coupling probe.

The present disclosure provides in yet another aspect a housing defining an inner cavity. A first input port is provided in the housing for radiating a first resonant mode into the cavity. A second input port is provided in the housing for radiating a second resonant mode into the cavity. The second resonant mode is orthogonal to the first mode. A resonator is positioned in the inner cavity. The resonator has a resonator body, a first member, a second member, a third member, and a fourth member. The first and second members extend laterally from the resonator body and opposite each other. The third and fourth members extend laterally from the resonator body, opposite each other and in a direction orthogonal to a direction of extension of the first and second member. Both the first resonant mode and the second resonant mode resonate within the cavity having the resonators.

BRIEF DESCRIPTION OF THE DRAWINGS

A detailed description of various exemplary embodiments is provided herein below with reference to the following drawings, by way of example only, and in which.

DETAILED DESCRIPTION OF VARIOUS EMBODIMENTS

It will be appreciated that numerous specific details are set forth in order to provide a thorough understanding of the exemplary embodiments described herein. However, it will be understood by those of ordinary skill in the art that the embodiments described herein may be practiced without these specific details. In other instances, well-known methods, procedures and components have not been described in detail so as not to obscure the embodiments described herein. Furthermore, this description is not to be considered as limiting the scope of the embodiments described herein in any ways, but rather as merely describing the implementation of the various embodiments described herein.

Figure 1:
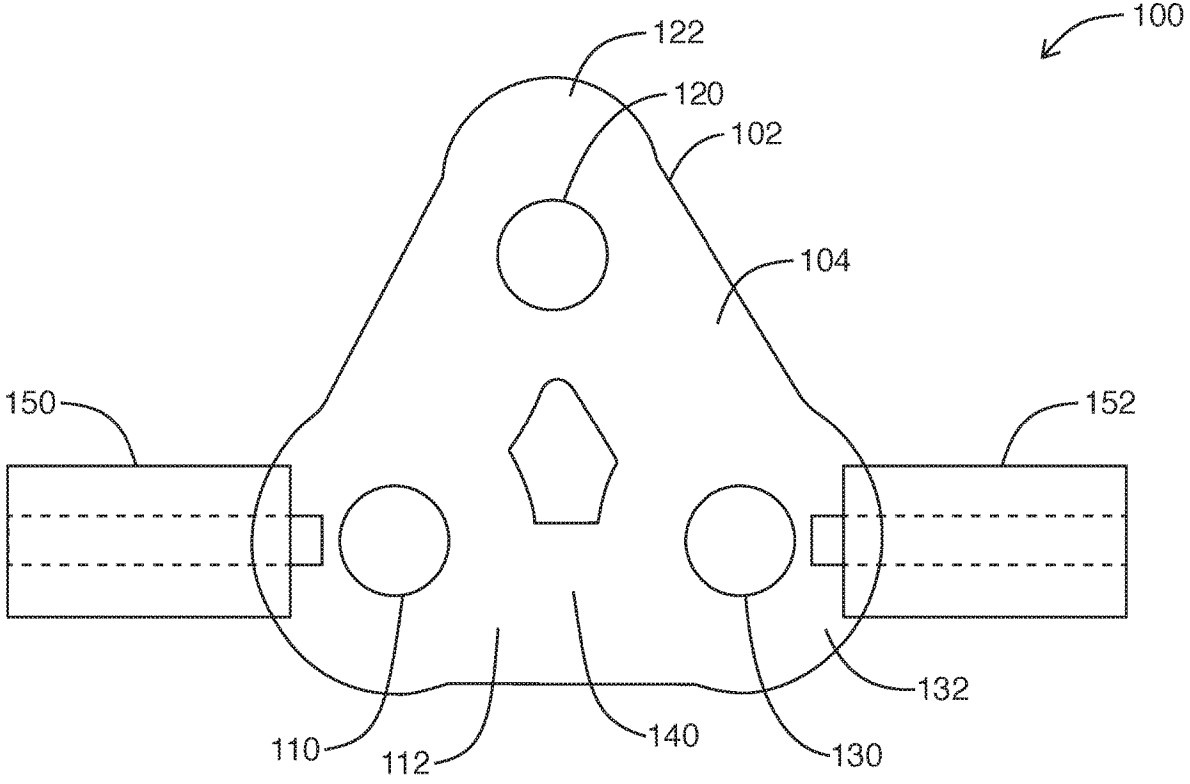
(PRIOR ART) FIG. 1
FIG. 1 is a plan view of a prior art microwave filter.

Referring now to FIG. 1, therein illustrated is a plan view of a microwave coaxial filter 100 commonly used in the art. Microwave coaxial filter 100 includes a housing 102 defining an inner cavity 104. A first resonator 110 is positioned in a first portion 112 of the inner cavity 104. A second resonator 120 is positioned in a second portion 122 of the inner cavity 104. A third resonator 130 is positioned in a third portion 132 of the inner cavity 104.

Typically, each of the first resonator 110, second resonator 120 and third resonator 130 has a cylindrical body defined by a circular cross-section, as shown. Alternatively, the first resonator 110, second resonator 120 or third resonator 130 can have a cross section wherein the cross-sectional width is substantially equal to the cross-section length, such as a square cross-section. Accordingly, for each individual resonator, the electric field propagating to and from that resonator is oriented in the same direction and in phase over the surface of the resonator. Each of the first resonator 110, second resonator 120 and third resonator 130 can be fixed to the housing floor.

The first portion 112 of the inner cavity 104 is in fluid communication with the second portion 122 of the inner cavity 104, thereby allowing the first resonator 110 to be electromagnetically coupled to the second resonator 120. The first resonator 110 and the second resonator 120 are adjacent resonators. The coupling between the first resonator 110 and the second resonator 120 can be modeled as being dominantly inductive.

The second portion 122 of the inner cavity 104 is in fluid communication with the third portion 132 of the inner cavity 104, thereby allowing the second resonator 120 to be electromagnetically coupled to the third resonator 130. The second resonator 120 and the third resonator 130 are adjacent resonators. The coupling between the second resonator 120 and the third resonator 130 can be modeled as being dominantly inductive.

The first portion 112 of the inner cavity 104 is further in fluid communication with the third portion 132 of the inner cavity 104 via an iris 140. The first resonator 110 and the third resonator 130 are non-adjacent resonators. The first resonator 110 is electromagnetically cross-coupled to the third resonator 130 via the iris 140. The coupling between the first resonator 110 and the third resonator 130 can be modeled as being dominantly inductive.

Signals propagating through the inner cavity 104 from an input 150 to an output 152 can propagate over two paths. Over the first path, signals propagate from the first resonator 110 to the second resonator 120 to the third resonator 130 (R1-R2-R3). In the examples described herein, the terms R1, R2, R3 etc. are used to refer to the first resonator, second resonator, third resonator etc. respectively of a given embodiment, such as the first resonator 110, second resonator 120 and third resonator 130 in the example of FIG. 3. Over the second path, signals propagate from the first resonator 110 to the third resonator 130 (R1-R3).

Figure 2:
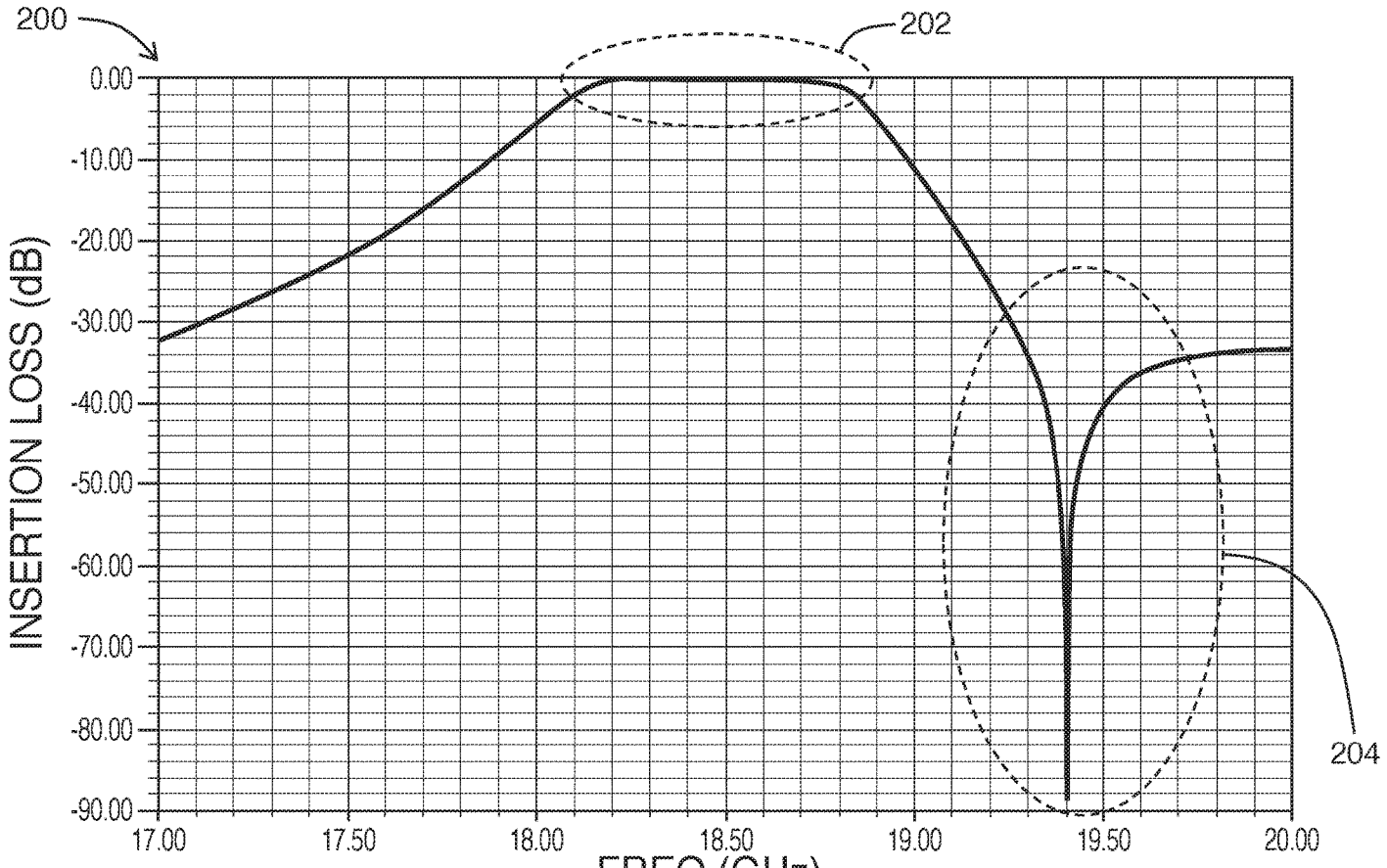
(PRIOR ART) FIG. 2
FIG. 2 is a schematic diagram showing one trace of the frequency response of the prior art microwave filter of FIG. 1.

Referring now to FIG. 2, therein illustrated is a frequency response 200 of the microwave coaxial filter 100, the x-axis representing frequencies in GHz and the y-axis representing insertion loss in dB. Signals having frequencies above the passband 202 that arrive at the output 152 over the first path R1-R2-R3 are out of phase with signals having frequencies above the passband 202 that arrive at the output 152 over the second path R1-R3. A transmission zero 204 is formed in an upper stop band at frequencies above the passband 202. The location of the transmission zero in the stopband can be adjusted using one or more of tuning screws, decoupling walls, resonator adjustments or other mechanisms according to techniques known in the art. It will be appreciated that the microwave coaxial filter 100 has the behavior of a low-pass filter.

Figure 3:
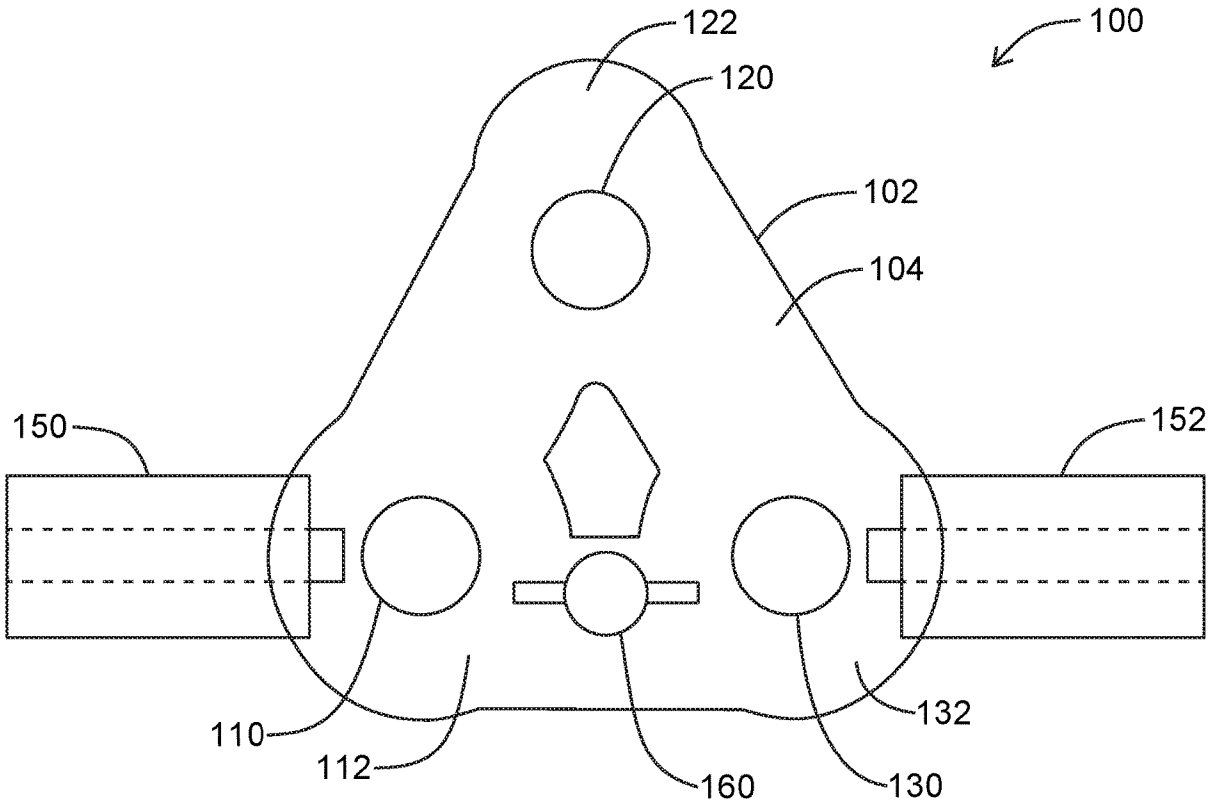
(PRIOR ART) FIG. 3
FIG. 3 is a plan view of a prior art microwave filter.

Referring now to FIG. 3, therein illustrated is a plan view of a microwave coaxial filter 100 commonly used in the art wherein a cross-coupling probe 160 has been added. The cross-coupling probe 160 is positioned to cross-couple the first resonator 110 and third resonator 130. According to some exemplary embodiments, the first portion 112 of the inner cavity 104 is in fluid communication with the third portion 132 of the inner cavity 104. Alternatively, the first portion 112 of the inner cavity 104 is not in fluid communication with the third portion 132 of the inner cavity 104, and a cross-coupling between the first resonator 110 and the third resonator 130 is provided only by the cross-coupling probe 160.

Continuing with reference to FIG. 3, the second resonator 120 couples to the first resonator 110 and the third resonator 130. These couplings can be modeled as being dominantly inductive. Signals having frequencies below the passband that arrive at the output 152 over the first path R1-R2-R3 are out of phase with signals having frequencies below the passband that arrive at the output 152 over the second path R1-R3. A transmission zero is formed in a lower stop band at frequencies below the passband 202 of FIG. 2. It will be appreciated that the microwave coaxial filter 100 with capacitive cross-coupling probe 160 has the behavior of a high-pass filter.

While the addition of the cross-coupling probe 160 allows a transmission zero to be located in the lower stopband of the microwave filter 100, the cross-coupling probe 160 introduces certain disadvantages. For example, the cross-coupling probe 160 can generate unwanted resonances that degrade filter performance. For example, the unwanted resonances degrade near-band and wide-band transmission characteristics. Fabrication of the cross-coupling probe can also be difficult, in particular, at high frequencies (such as microwave frequencies). Furthermore, because the cross-coupling probe must be placed inside the filter, accessing the probe to tune the filter requires more parts of the filter to be moved. This further causes the tuning process to be more sensitive and difficult. Accordingly, the process for tuning a microwave filter 100 having a cross-coupling probe 160 becomes more difficult and more expensive.

Figure 4:
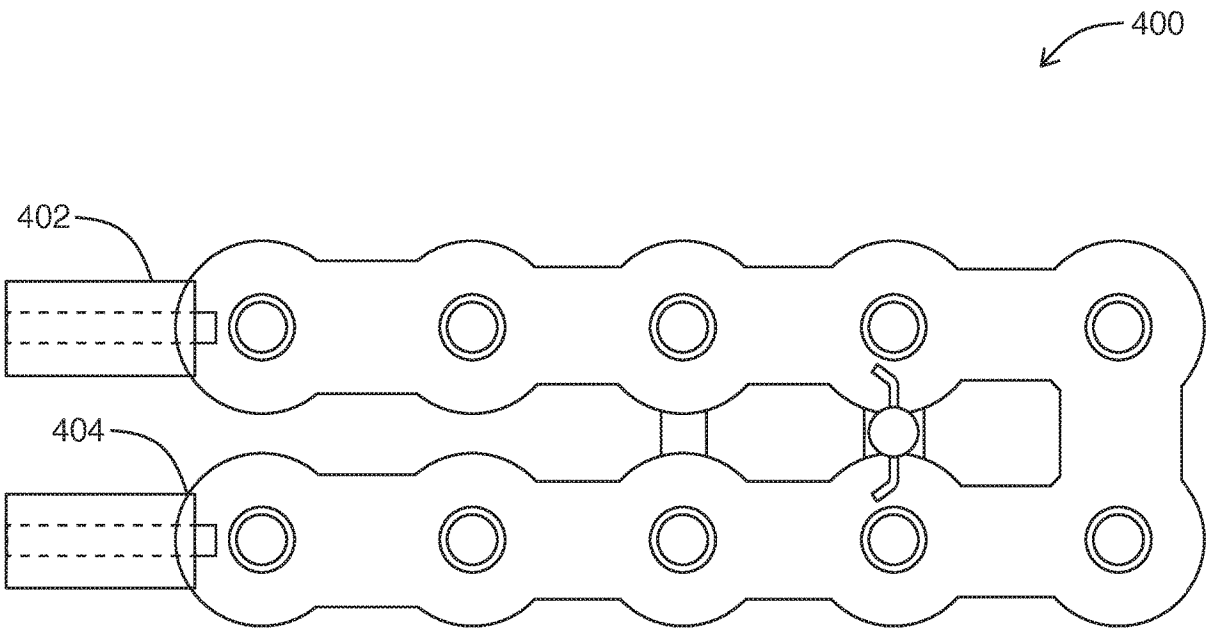
(PRIOR ART) FIG. 4
FIG. 4 is a plan view of a 10-pole prior art microwave filter.

Referring now to FIG. 4, therein illustrated is a plan view of a 10-pole microwave coaxial filter 400 having a cross-coupling probe commonly used in the art. In addition to the disadvantages of the cross-coupling probe described above, the input 402 and output 404 of the filter are facing in the same direction, which can cause difficulties when integrating the filter into a microwave communication system.

Figure 5:
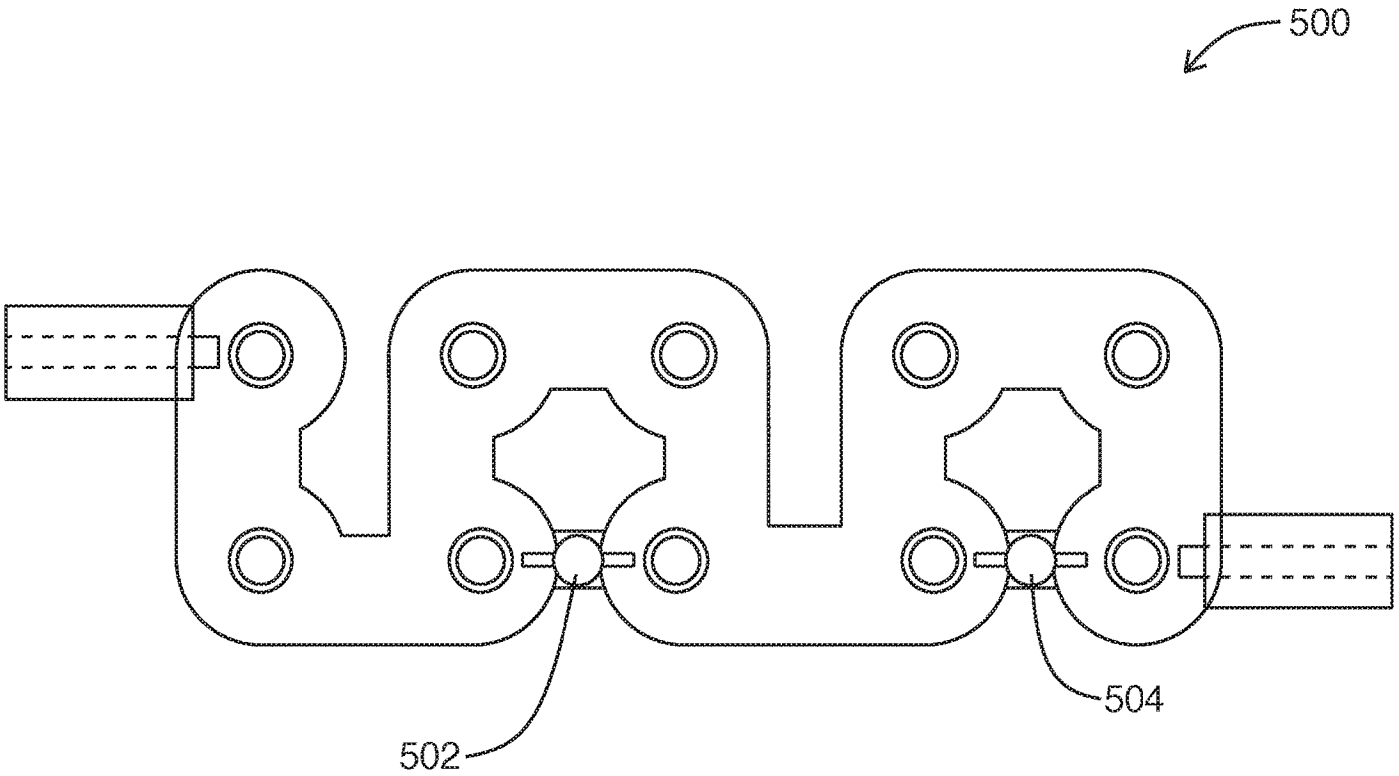
(PRIOR ART) FIG. 5
FIG. 5 is a plan view of a 10-pole prior art microwave filter.

Referring now to FIG. 5, therein illustrated is a plan view of a 10-pole microwave coaxial filter 500 commonly used in the art. It will be appreciated that the microwave coaxial filter 500 has two cross-coupling probes 502 and 504. The inclusion of multiple cross-coupling probes can increase the above-described disadvantages of cross-coupling probes.

Other techniques used to realize transmission zeros include extracted pole technique and non-resonating nodes technique. However both techniques require additional resonating or non-resonating structures, which lead to further size and mass increase.

Figure 6:
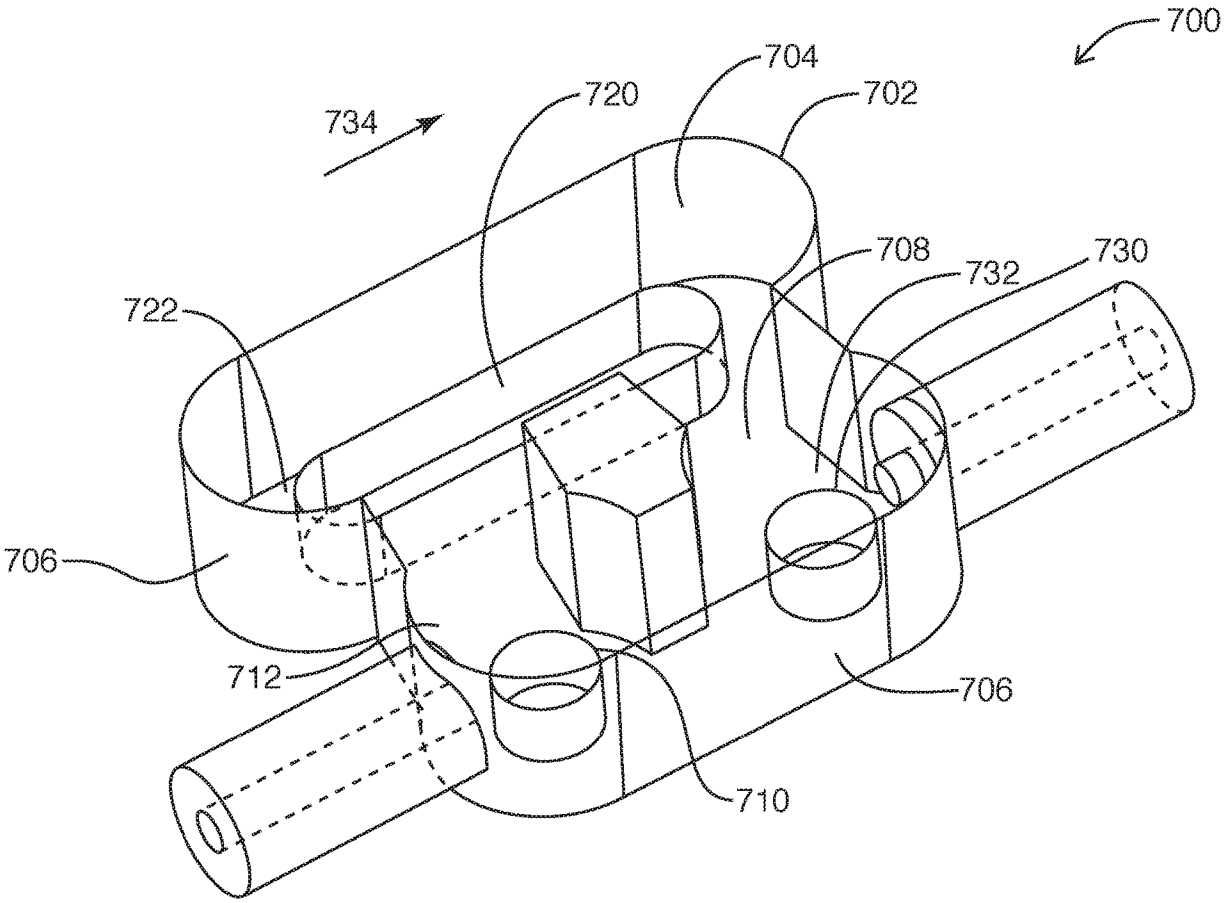
FIG. 6 is a perspective view of a microwave filter having an elongated resonator according to one exemplary embodiment.
Figure 7:
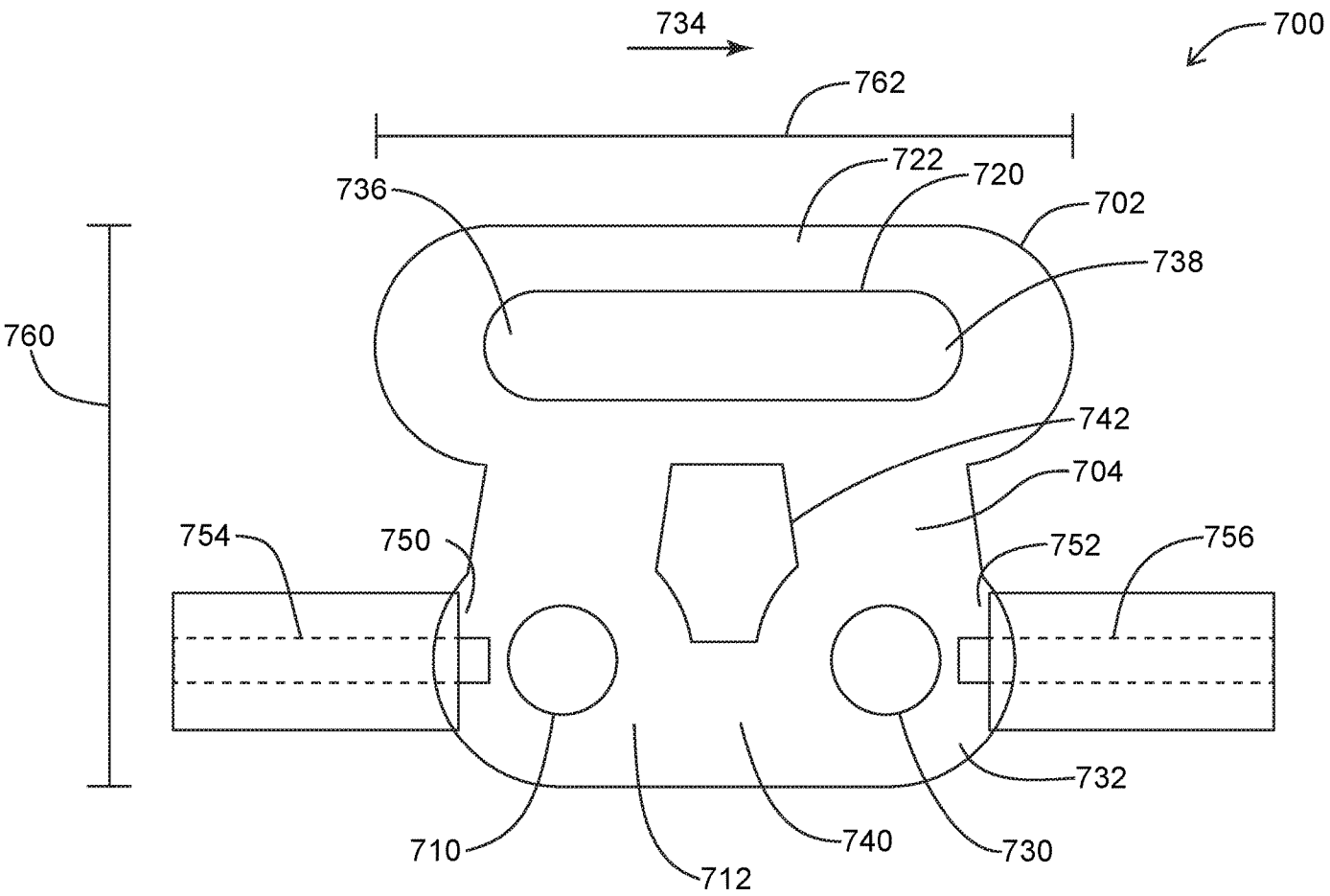
FIG. 7 is a plan view of the microwave filter of FIG. 6 according to one exemplary embodiment.

Referring now to FIGS. 6 and 7, therein illustrated are a perspective view and a plan view respectively, of a microwave coaxial filter 700 according to various exemplary embodiments. The microwave coaxial filter 700 has a housing 702 defining an inner cavity 704. The housing 702 has housing walls 706 and a housing floor 708 as shown in FIG. 6. According to some exemplary embodiments, the housing can further have one or more removable lids (not shown). For example, the removable lid can be placed opposite the housing floor 708 to seal the inner cavity 704. Alternatively, a housing ceiling (not shown) positioned opposite the housing floor 708 seals the inner cavity 704. The housing 702 can be made of a suitable metal such as aluminum or copper. However, the housing 702 can be formed of other suitable materials such that electromagnetic signals are contained within the inner cavity 704 inside the housing 702. Although the housing 702 is typically translucent, for ease of explanation, the housing 702 is shown in FIG. 6 as being transparent.

A first resonator 710 is positioned in a first portion 712 of the inner cavity 704. A second resonator 720 is positioned in a second portion 722 of the inner cavity 704. A third resonator 730 is positioned in a third portion 732 of the inner cavity 704. Each of the first resonator 710, the second resonator 720 and the third resonator 730 can be fixed to the housing floor 708.

The first resonator 710 has a cylindrical body defined by a circular cross-section. The third resonator 730 also has a cylindrical body defined by a circular-cross-section. Alternatively, the first resonator 710 and the third resonator 730 can each have a cross section wherein the cross-sectional width is substantially equal to the cross-sectional length, such as a square cross-section.

The second resonator 720 is elongated. As shown, in FIGS. 6 and 7, the cross section of the second resonator 720 in a plane parallel to the housing floor 708 is elongated in a lengthwise direction, such that the second resonator 720 has a length that is substantially greater than its width. For example, the second resonator 720 can have an oval cross-section as shown in FIG. 7. Alternatively, the second resonator 720 can have any other suitable cross-section wherein the cross-sectional length is greater than its cross-sectional width. For example, the second resonator 720 can have an elongated rectangular shape. In addition, and for example, the ratio of the length of the second resonator 720 to the width of the second resonator 720 can be between 2 to 5 and preferably 4.5. Note that there is a trade-off between the width and the length of the elongated resonator, i.e. greater the width, less the length. When electromagnetic signals are propagating within the inner cavity 704, the second resonator 720 is elongated in a direction parallel to the orientation of the magnetic field.

Figure 8:
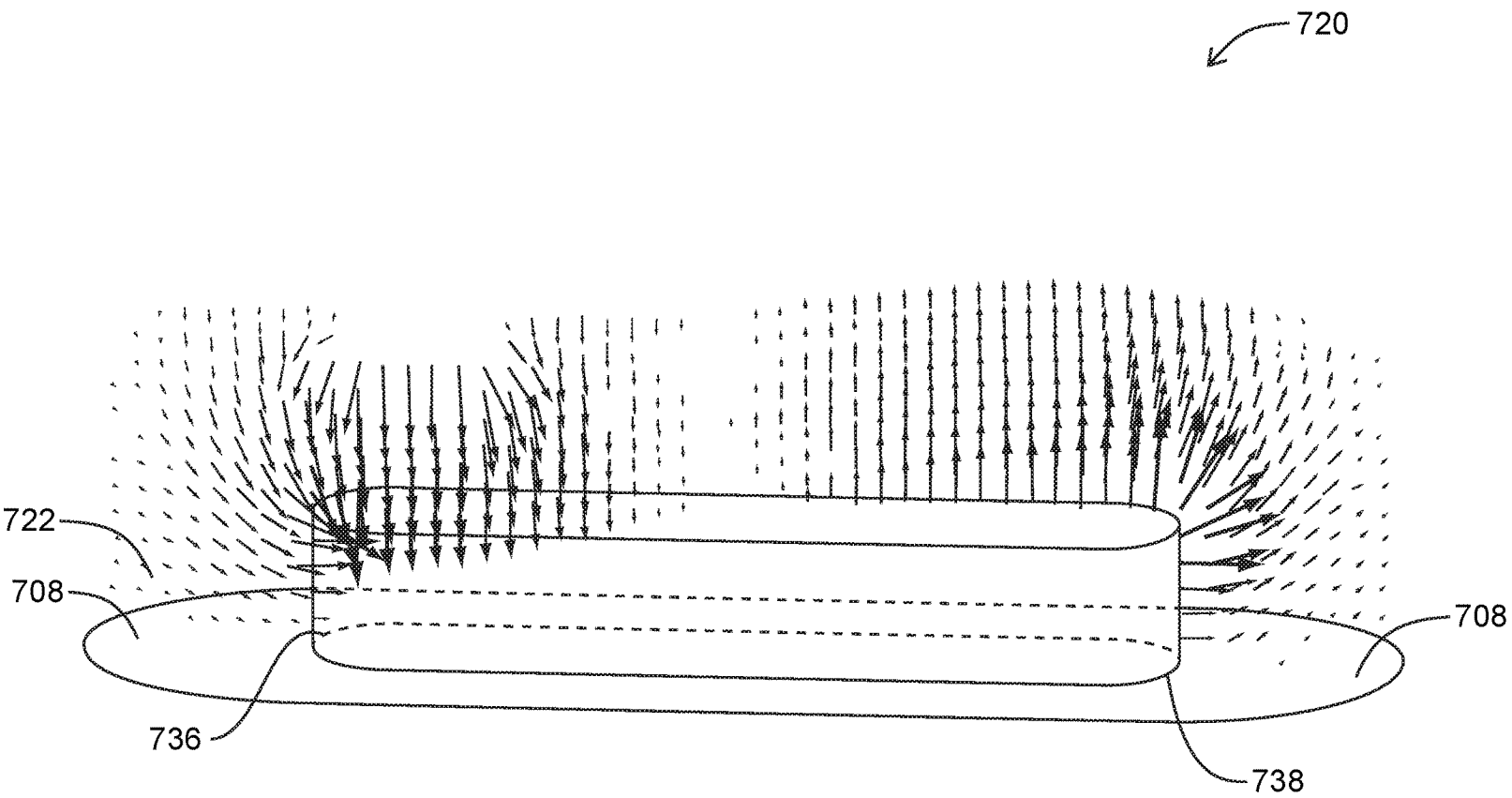
FIG. 8 is a perspective view of the elongated resonator of the microwave filter of FIG. 6 or 7.

Referring now to FIG. 8, therein illustrated is a perspective view of the second resonator 720 positioned in the second portion 722 of the inner cavity 704 according to various exemplary embodiment. When electromagnetic signals are propagating in the inner cavity 704, the electric field at a first end region 736 of the second resonator 720 has a different orientation from the electric field at a second end region 738 of the second resonator 720. The shape of the elongated second resonator 720 can be appropriately chosen such that the electric field at a first end region 736 of the second resonator 720 is out of phase with the electric field at a second end region 738 of the second resonator 720. As shown in FIG. 8, the electric field at the first end 736 is oriented downwardly towards the housing floor 708 and inwardly towards the body of the elongated second resonator 720. The electric field at the second end region 738 is oriented upwardly away from the housing floor 708 and outwardly away from the body of the elongated second resonator 720 to be out of phase with the electric field at the first end 736. It will be appreciated that the electric field behavior of the elongated second resonator 720 differs from the electric field behavior of a resonator having a circular cross-section, namely in that the electric field of the resonator having a circular cross-section is oriented in substantially the same direction and is in phase.

Returning back to FIGS. 6 and 7, the first portion 712 of the inner cavity 704 is in fluid communication with the second portion 722 of the inner cavity 704, thereby allowing the first resonator 710 to be electromagnetically coupled to the second resonator 720. The first resonator 710 and the elongated second resonator 720 are adjacent resonators. For example, the first resonator 710 can be predominantly electromagnetically coupled to the first end 736 of the elongated second resonator 720. The electromagnetic coupling between the first resonator 710 and the elongated second resonator 720 can be modeled as being dominantly inductive.

The second portion 722 of the inner cavity 704 is in fluid communication with the third portion 732 of the inner cavity 704, thereby allowing the elongated second resonator 720 to be electromagnetically coupled to the third resonator 730. The elongated second resonator 720 and the third resonator 730 are adjacent resonators. For example, the third resonator 730 can be predominantly electromagnetically coupled to the second end 738 of the elongated second resonator 720.

The electromagnetic coupling between the elongated second resonator 720 and the third resonator 730 can be modeled as being dominantly inductive.

The first portion 712 of the inner cavity 704 is further in fluid communication with the third portion 732 of the inner cavity 704. For example, the fluid communication is provided by an iris 740, as shown in FIG. 7. The first resonator 710 and the third resonator 730 are non-adjacent resonators. The first resonator 710 is electromagnetically cross-coupled to the third resonator 730, for example, via the iris 740. The first resonator 710 is electromagnetically cross-coupled to the third resonator 730. Notably, the cross-coupling is free of a cross-coupling probe. The cross-coupling between the first resonator 710 and the third resonator 730 can be modeled as being dominantly inductive.

According to various exemplary embodiments, first resonator 710, second resonator 720 and third resonator 730 are positioned within the housing 702 to define a geometric shape. For example, the three resonators can be arranged to define a triangular shape. The housing 702 can have inner walls 742 (FIG. 7) positioned within the geometric shape defined by the positions of the resonators. The inner walls 742 provide a separation between the resonators and with the housing 702. The inner walls 742 and the housing 702 together define the first portion 712, second portion 722 and third portion 732 of the cavity 704 as shown in FIG. 7. The inner walls 742 can further define with the housing 702 channels of the inner cavity 704 providing fluid communication between the first resonator 710, second resonator 720 and/or the third resonator 730.

According to various exemplary embodiments, the microwave coaxial filter 700 has an input port 750 and an output port 752 as shown in FIG. 7. The input port 750 can form an electromagnetic connection with the first resonator 710 such that signals provided at input port 750 initially resonate at the first resonator 710. The output port 752 forms an electromagnetic connection with the third resonator 730 such that signals resonating at the third resonator 730 are outputted via the output port 752. It will be understood that input port 750 and output port 752 have been denoted as input and output respectively for ease of notation only, and that the use of the ports as either an input or an output is interchangeable. For example, input port 750 and output port 752 can be connected to coaxial cables or connectors. An inner conductor of a coaxial cable or connector at the input port 750 can provide a first waveguide 754. An inner conductor of coaxial cable or connector at the output port 752 can provide a second waveguide 756.

Signals propagating through the inner cavity 704 from the first resonator 710 to the third resonator 730 can propagate over two paths. Over the first path, signals propagate from the first resonator 710 to the elongated second resonator 720 to the third resonator 730 (R1-R2-R3). Over the second path, signals propagate from the first resonator 710 to the third resonator 730 (R1-R3).

Along the first signal path R1-R2-R3, the elongated second resonator 720 couples to the first resonator 710 and the third resonator 730. The coupling between the first and the second resonators 710 and 720 as well as the second and the third resonators 720 and 730 can be modeled as being dominantly inductive. Along the signal path R1-R3, the coupling between the first and the third resonators can be modeled dominantly inductive.

Figure 9:
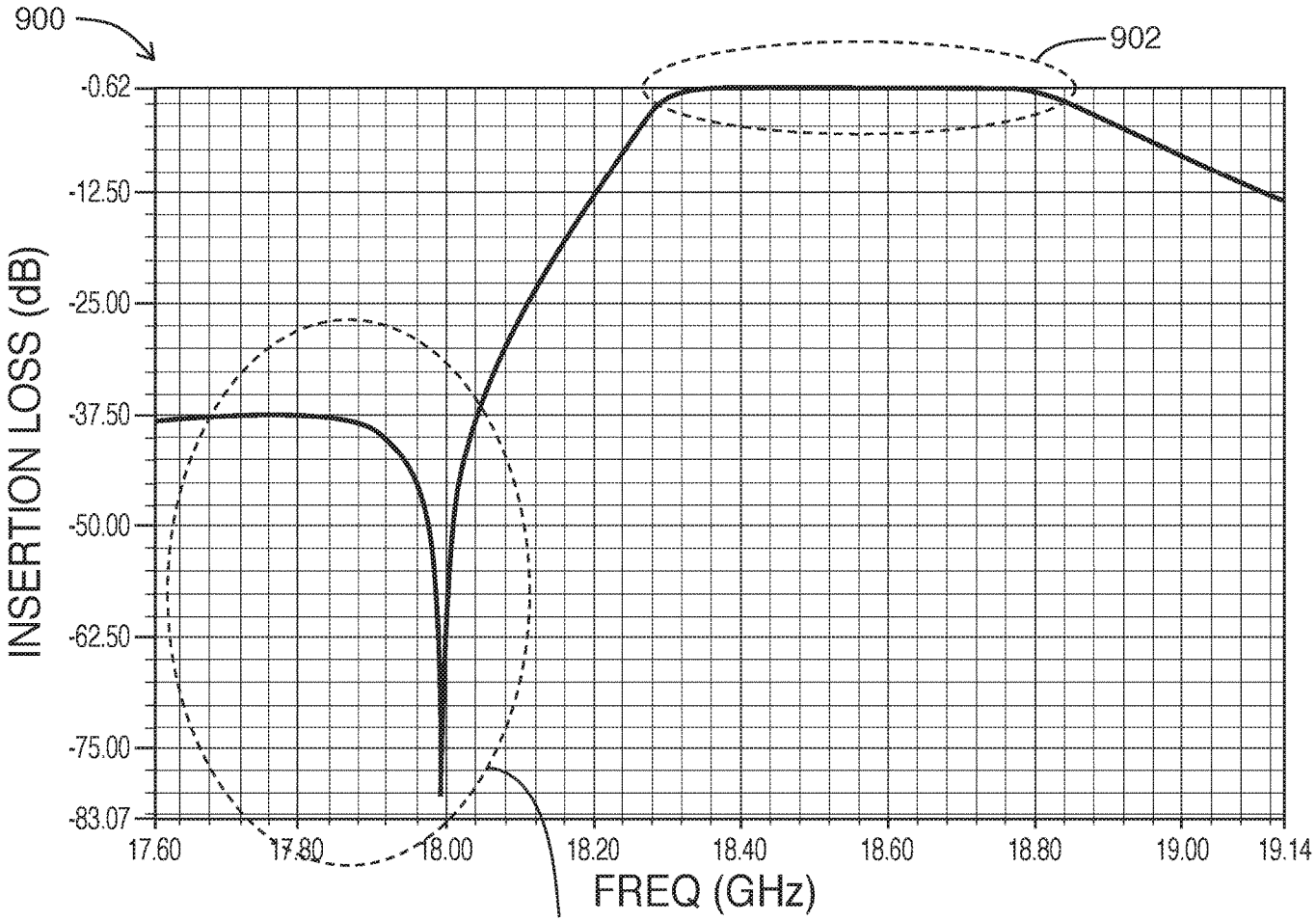
FIG. 9 is a schematic diagram showing one trace of the frequency response of the microwave filter of FIG. 7.

Referring now to FIG. 9, therein illustrated is a frequency response 900 of the microwave coaxial filter 700, the x-axis representing frequencies in GHz and the y-axis representing insertion loss in dB. Signals having frequencies below the passband that arrive at the third resonator 730 over the first path R1-R2-R3 are out of phase with signals having frequencies below the passband that arrive at the third resonator 730 over the second path R1-R3. A transmission zero 904 is formed in a lower stop band at frequencies below the passband 902. This cross coupling behavior is due to the elongated shape of the elongated second resonator 720 and the out-of-phase orientations of the electric field at the first end region 736 and the electric field at the second end region 738. The location of the transmission zero 904 in the stopband can be adjusted using one or more of tuning screws, decoupling walls, adjustments of the first resonator 710 and/or third resonator 730 or other mechanisms according to techniques known in the art. It will be appreciated that the transmission zero 904 in the lower stop band is achieved using the microwave filter 700 having the elongated second resonator 730 without use of a cross-coupling probe. In particular, a cross-coupling probe is not used to cross-couple the first resonator 710 with the third resonator 730.

The location of the transmission zero 904 can be further adjusted by varying the length of the elongated second resonator 720. For example, increasing the length of the elongated second resonator 720 causes the transmission zero 904 to shift towards a lower frequency. Advantageously, since the microwave filter 700 with the elongated second resonator 720 is free of any cross-coupling probe for cross-coupling any one of the Furthermore, performance of the microwave filter 700 is significantly improved due to the absence of a cross-coupling probe.

Figure 10:
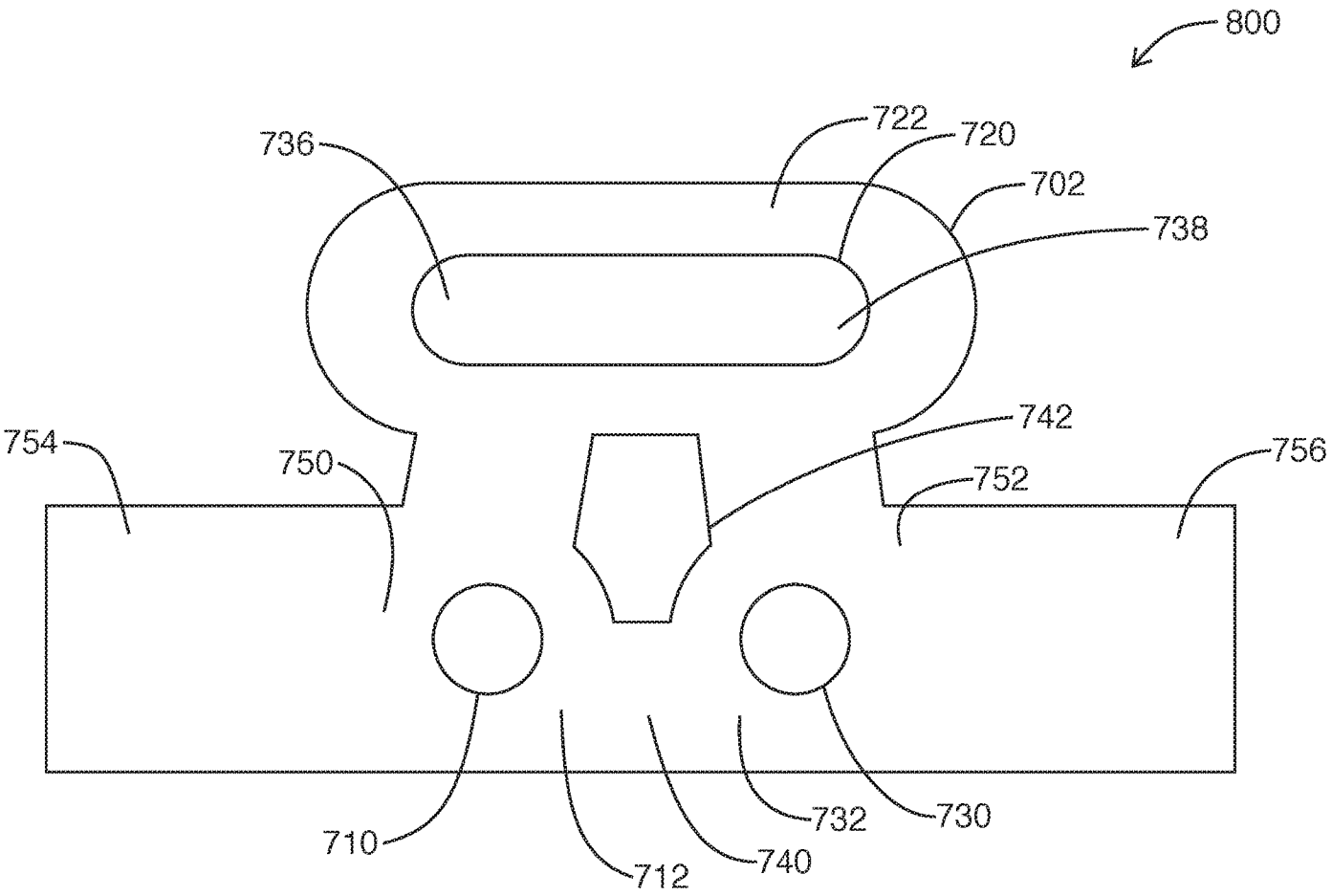
FIG. 10 is a plan view of a microwave filter having an elongated resonator according to one exemplary embodiment.

Referring now to FIG. 10, therein illustrated is a plan view of a microwave coaxial filter 800 according to an alternate exemplary embodiment. Reference numerals may be repeated from FIG. 7 to indicate corresponding or analogous elements. Instead of an electromagnetic connection between the input port 750 (ex: a coaxial port) and first resonator 710, the input port 750 is a coupling aperture. As a result, the first portion 712 of the inner cavity 704 is in fluid communication with a first waveguide 754. Instead of an electromagnetic connection between the third resonator 730 (a coaxial port) and the output port 752, the output port 752 is a coupling aperture. As a result, the third portion 732 of the inner cavity 704 is in fluid communication with a second waveguide 756. Electromagnetic signals propagating through the first waveguide 754 can resonate at the first resonator 710 and further be filtered by the microwave filter 700. The filtered electromagnetic signals can then be propagated through the second waveguide 756. For example, the first waveguide 754 and second waveguide 756 can be respectively connected to an external waveguide for receiving and transmitting electromagnetic signals. Alternatively, the first waveguide 754 and the second waveguide 756 are part of a waveguide resonator wherein the microwave filter 700 is a sub-element of the waveguide resonator. For example, the housing 702 can be integrally formed with the first waveguide 754 and the second waveguide 756.

Referring now to FIGS. 6, 7, 8 and 10 together, the elongated second resonator 720 is shown to be extending linearly. For example, the direction of the extension of the elongated second resonator 720 between the first end 736 and second end 738 can be defined by a vector 734 (FIGS. 6 and 7). According to exemplary embodiments wherein the elongated second resonator 720 extends linearly, the overall width 760 (FIG. 7) of the microwave filter 700 is substantially the same as the prior art microwave low-pass filter 100 as shown in FIGS. 1 and 3. However, the size of the second portion 722 of the housing 702 must be increased in order to accommodate the elongated second resonator 720. As a result, a length 762 (FIG. 7) of the microwave filter 700 may be increased.

Figure 11:
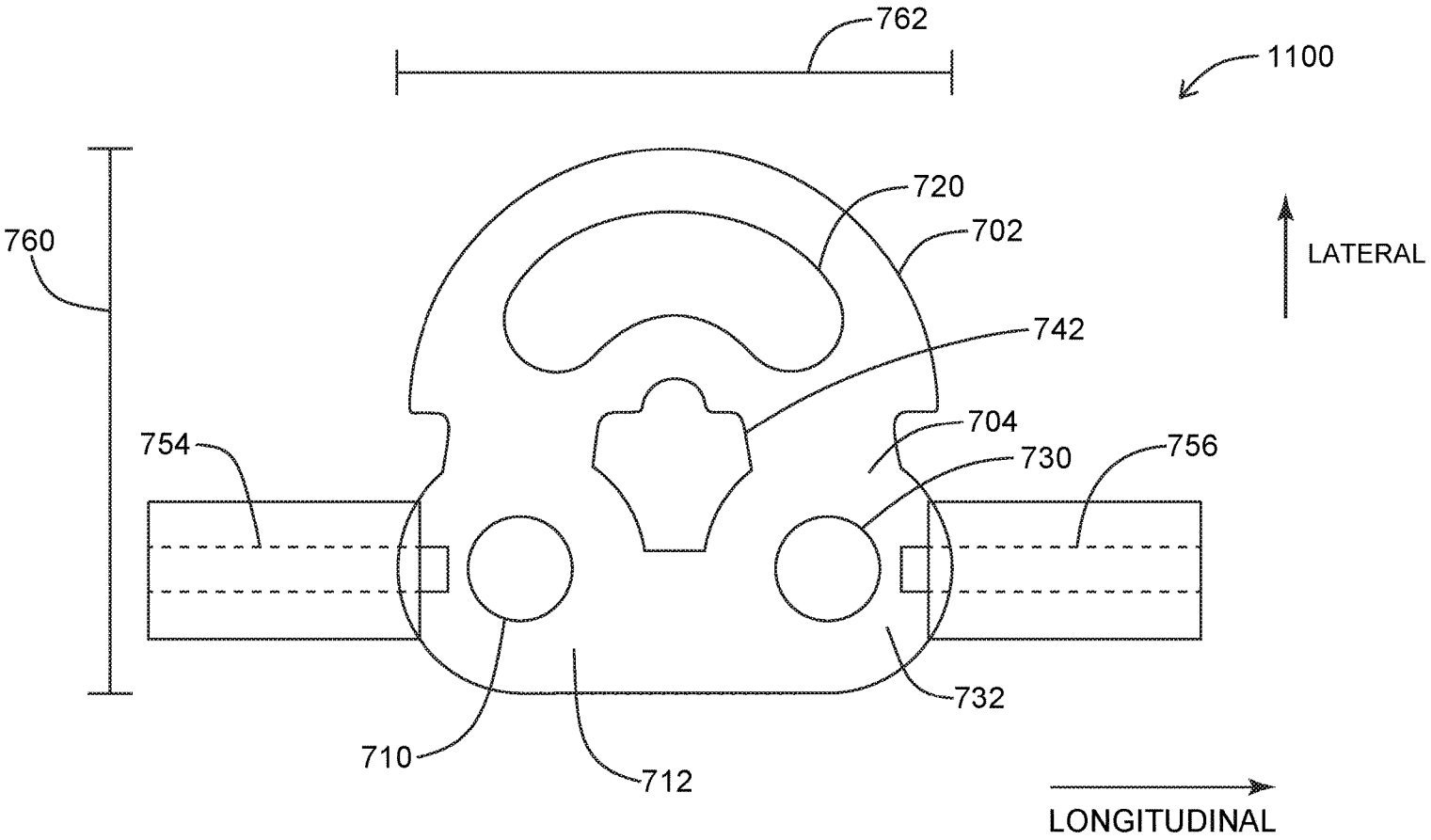
FIG. 11 is a plan view of a microwave filter having an elongated resonator according to one exemplary embodiment.

Referring now to FIG. 11, therein illustrated is a plan view of the microwave filter 1100 according to an alternate exemplary embodiment. As shown in FIG. 11, the vertical direction, or bottom-to-top direction, may be designated as a lateral direction. In FIG. 11, the horizontal direction, or left-to-right direction, may be designated as a longitudinal direction. Reference numerals may be repeated from FIG. 7 to indicate corresponding or analogous elements. The elongated second resonator 720 has a curved shape. Advantageously, the curvedly shaped elongated second resonator 720 allows the length 762 of the microwave filter 1100 to be kept shorter. However substantially same end-to-end length of the elongated second resonator 720 is maintained. The curvedly shaped elongated second resonator 720 may require that the width 760 of the housing 702 to be increased in order to accommodate the curved elongated second resonator 720.

According to various exemplary embodiments, the elongated second resonator 720 can have other suitable shapes that cause the electric field at the first end 736 to be out-of-phase with the electric field of the second end 738. The elongated second resonator 720 can be S-shaped. Such a shape provides a trade-off between increasing the width and the length of the housing 702 while maintaining the end-to-end length of the elongated second resonator 720. Alternatively, at least one of the first end 736 or second end 738, or both, is larger than a portion of the elongated second resonator 720 joining the two ends. For example, the elongated third resonator 730 can be dumbbell-shaped. Various alternate shapes of the elongated second resonator 720 allows for decreasing the length of 762 of the resonator 720.

Figure 12A:
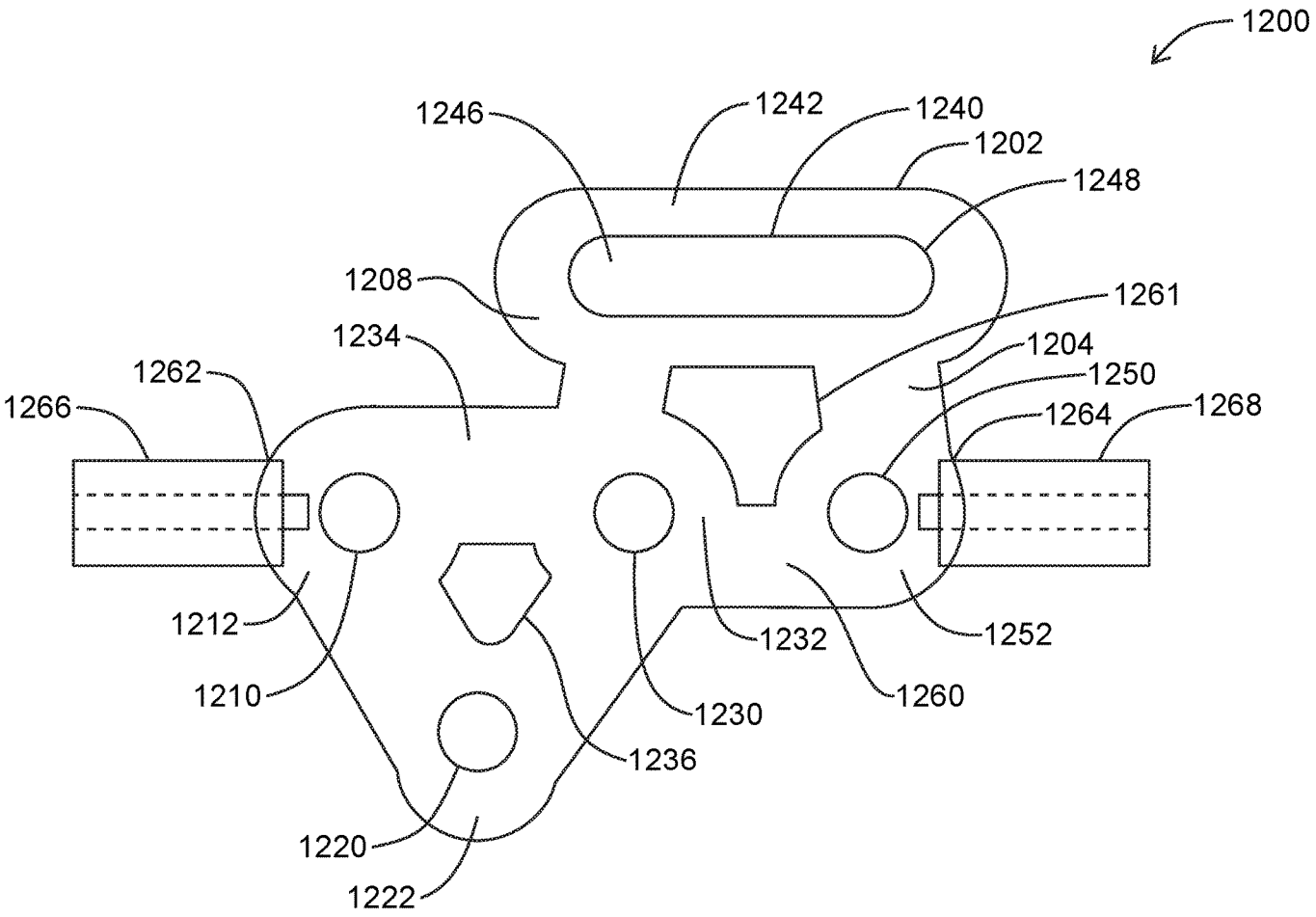
FIG. 12A is a plan view of 5-pole microwave filter having an elongated resonator according to one exemplary embodiment.

Referring now to FIG. 12A, therein illustrated is a microwave coaxial filter 1200 having a bandpass frequency response according to various exemplary embodiments. The microwave coaxial filter 1200 has a housing 1202 defining an inner cavity 1204. The housing 1202 has housing walls and a housing floor. According to some exemplary embodiments, the housing can further have one or more removable lids (not shown). For example, the removable lid can be placed opposite the housing floor to seal the inner cavity 1204. Alternatively, a housing ceiling (not shown) positioned opposite the housing floor seals the inner cavity 1204. The housing can be made of a suitable metal such as aluminum or copper. However, the housing 1202 can be formed of other suitable materials such that electromagnetic signals are contained within the inner cavity 1204 inside the housing 1202.

A first resonator 1210 is positioned in a first portion 1212 of the inner cavity 1204. A second resonator 1220 is positioned in a second portion 1222 of the inner cavity 1204. A third resonator 1230 is positioned in a third portion 1232 of the inner cavity 1204. Each of the first resonator 1210, second resonator 1220 and third resonator 1230 can be fixed to the housing floor.

The first resonator 1210, the second resonator 1220 and the third resonator 1230 each has a cylindrical body defined by a circular cross-section. Alternatively, the first resonator 1210, the second resonator 1220, and the third resonator 1230 can have a cross section wherein the cross-sectional width is substantially equal to the cross-section length, such as a square cross-section.

The first portion 1212 of the inner cavity 1204 is in fluid communication with the second portion 1222, thereby allowing the first resonator 1210 to be electromagnetically coupled to the second resonator 1220. The first resonator 1210 and the second resonator 1220 are adjacent resonators. The electromagnetic coupling between first resonator 1210 and the second resonator 1220 can be modeled as being dominantly inductive.

The second portion 1222 of the inner cavity 1204 is in fluid communication with the third portion 1232, thereby allowing the second resonator 1220 to be electromagnetically coupled to the third resonator 1230. The second resonator 1220 and the third resonator 1230 are adjacent resonators. The electromagnetic coupling between second resonator 1220 and the third resonator 1230 can be modeled as being dominantly inductive.

The first portion 1212 of the inner cavity 1204 is further in fluid communication with the third portion 1232 of the inner cavity 1204. For example, an iris 1234 allows the first portion 1212 to communicate with the third portion 1232. The first resonator 1210 and the third resonator 1230 are non-adjacent resonators. The coupling between the first resonator 1210 and third resonator 1230 can be modeled as being dominantly inductive.

According to various exemplary embodiments, first resonator 1210, second resonator 1220 and third resonator 1230 are positioned within the housing 1202 to define a geometric shape. For example, the three resonators can be arranged to define a triangular shape. The housing 1202 can have first inner walls 1236 positioned within the geometric shape defined by the positions of the resonators 1210, 1220, and 1230. The first inner walls 1236 provide a separation between the resonators and with the housing 1202. The inner walls 1236 and the housing 1202 together define the first portion 1212, second portion 1222, and third portion 1232 of the cavity 1204. The first inner walls 1236 can further define with the housing 1202 channels of the inner cavity 1204 providing fluid communication between the first resonator 1210, second resonator 1220, and the third resonator 1230.

It will be appreciated that the first resonator 1210 located in the first portion 1212 of the inner cavity 1204, the second resonator 1220 located in the second portion 1222 of the inner cavity 1204 and the third resonator 1230 located in the third portion 1232 of the inner cavity 1204 share the same characteristics as the resonators of the low-pass microwave coaxial filter 100 (FIG. 1) commonly used in the art.

A fourth resonator 1240 is positioned in a fourth portion 1242 of the inner cavity 1204. A fifth resonator 1250 is positioned in a fifth portion 1252 of the inner cavity 1204. Each of the fourth resonator 1240 and fifth resonator 1250 can be fixed to the housing floor.

The fifth resonator 1250 has a cylindrical body defined by a circular cross-section. Alternatively, the fifth resonator 1250 can have a cross section wherein the cross-sectional width is substantially equal to the cross-section length, such as a square cross-section.

The fourth resonator 1240 is elongated. The cross section of the fourth resonator 1240 in a plane parallel to the housing floor 1208 is elongated in a lengthwise direction, such that the elongated fourth resonator 1240 has a length that is substantially greater than its width. For example, the fourth resonator 1240 can have an oval cross-section as shown in FIG. 12A. Alternatively, the fourth resonator 1240 can have any other suitable cross-section wherein the cross-sectional length is greater than its cross-sectional width. For example, the fourth resonator 1240 can have an elongated rectangular shape.

In addition, and for example, the ratio of the length of the fourth resonator 1240 to the width of the fourth resonator 1240 is between 2 to 5. When electromagnetic signals are propagating within the inner cavity 1204, the fourth resonator 1240 is elongated in a direction parallel to the orientation of the magnetic field. The elongated fourth resonator 1240 can have the characteristics of the elongated second resonator 720 described herein with reference to FIGS. 6 to 11.

The third portion 1232 of the inner cavity 1204 is in fluid communication with the fourth portion 1242 of the inner cavity 1204, thereby allowing the third resonator 1230 to be electromagnetically coupled to the fourth resonator 1240. The third resonator 1230 and the elongated fourth resonator 1240 are adjacent resonators. For example, the third resonator 1230 can be predominantly electromagnetically coupled to a first end 1246 of the elongated fourth resonator 1240. The electromagnetic coupling between the third resonator 1230 and the elongated fourth resonator 1240 can be modeled as being dominantly inductive.

The fourth portion 1242 of the inner cavity 1204 is in fluid communication with the fifth portion 1252 of the inner cavity 1204, thereby allowing the elongated fourth resonator 1240 to be electromagnetically coupled to the fifth resonator 1250. The elongated fourth resonator 1240 and the fifth resonator 1250 are adjacent resonators. For example, the fifth resonator 1250 can be predominantly electromagnetically coupled to the second end 1248 of the elongated fourth resonator 1240. The electromagnetic coupling between the elongated fourth resonator 1240 and the fifth resonator 1250 can be modeled as being dominantly inductive.

The third portion 1232 of the inner cavity 1204 is further in fluid communication with the fifth portion 1252 of the inner cavity 1204. For example, the fluid communication is provided by an iris 1260. The third resonator 1230 and the fifth resonator 1250 are non-adjacent resonators. The third resonator 1230 is electromagnetically cross-coupled to the fifth resonator 1250, for example, via the iris 1260. The third resonator 1230 is electromagnetically cross-coupled to the fifth resonator 1250. Notably, the cross-coupling is free of a cross-coupling probe. The coupling between the third resonator 1230 and the fifth resonator 1250 can be modeled as being dominantly inductive. According to various exemplary embodiments, third resonator 1230, fourth resonator 1240 and fifth resonator 1250 are positioned within the housing 1202 to define a geometric shape. For example, these three resonators can be arranged to define a triangular shape. The housing 1202 can have second inner walls 1261 positioned within the geometric shape defined by the positions of the resonators 1230, 1240 and 1250. The second inner walls 1261 provide a separation between the resonators and with the housing 1202. The second inner walls 1261 and the housing 1202 together define the fourth portion 1242, fifth portion 1252 and sixth portion 1232 of the cavity 1204 as shown in FIG. 12A. The second inner walls 1261 can further define with the housing 1202 channels of the inner cavity 1204 providing fluid communication between the third resonator 1230, fourth resonator 1240 and/or the fifth resonator 1250.

According to various exemplary embodiments, the bandpass microwave coaxial filter 1200 has input port 1262 and an output port 1264. The input port 1262 can form an electromagnetic connection with the first resonator 1210 such that signals provided at input port 1262 initially resonate at the first resonator 1210. The output port 1264 forms an electromagnetic connection with the fifth resonator 1250 such that signals resonating at the fifth resonator 1250 are outputted via the output port 1264. It will be understood that input port 1262 and output port 1264 have been denoted as input and output respectively for ease of notation only, and that the use of the ports as either an input or an output is interchangeable. For example, input port 1262 and output port 1264 can be connected to coaxial cables or connectors 1266 and 1268.

According to various exemplary embodiments, the first resonator 1210, the third resonator 1230 and the fifth resonator 1250 can be substantially aligned to define an axis. Input port 1262 and output port 1264 can be further aligned with the axis. Accordingly, input port 1262 and output port 1264 are opposing. Moreover, the microwave filter 1200 can have a generally linearly elongated shape.

Signals propagating through the inner cavity 1204 from the first resonator 1210 to the third resonator 1230 can propagate over two paths. Over the first path, signals propagate from the first resonator 1210 to the second resonator 1220 to the third resonator 1230 (R1-R2-R3). Over the second path, signals propagate from the first resonator 1210 to the third resonator 1230 (R1-R3).

Along the first signal path R1-R2-R3, the second resonator 1220 couples to the first resonator 1210 and the third resonator 1230. The coupling between the first and the second resonators 1210 and 1220 as well as the coupling between the second and the third resonators 1220 and 1230 can be modeled as being dominantly inductive.

After having reached the third resonator 1230, signals can further propagate from the first resonator 1230 to the fifth resonator 1250 and output 1264 over two paths. Over the first path, signals propagate from the third resonator 1230 to the fourth resonator 1240 to the fifth resonator 1250 (herein referred to as R3-R4-R5). Over the second path, signals propagate from the third resonator 1230 to the fifth resonator 1250 (herein referred to as R3-R5).

Along the first signal path R3-R4-R5, the elongated fourth resonator 1240 couples to the third resonator 1230 and the fifth resonator 1250. These couplings between the third and the fourth resonators 1230 and 1240 as well as the coupling between the fourth and the fifth resonators 1240 and 1250 can be modeled as being dominantly inductive. For the second signal path R3-R5, the coupling between the third and the fifth resonators 1230 and 1250 can be modeled as being dominantly inductive.

Figure 13:
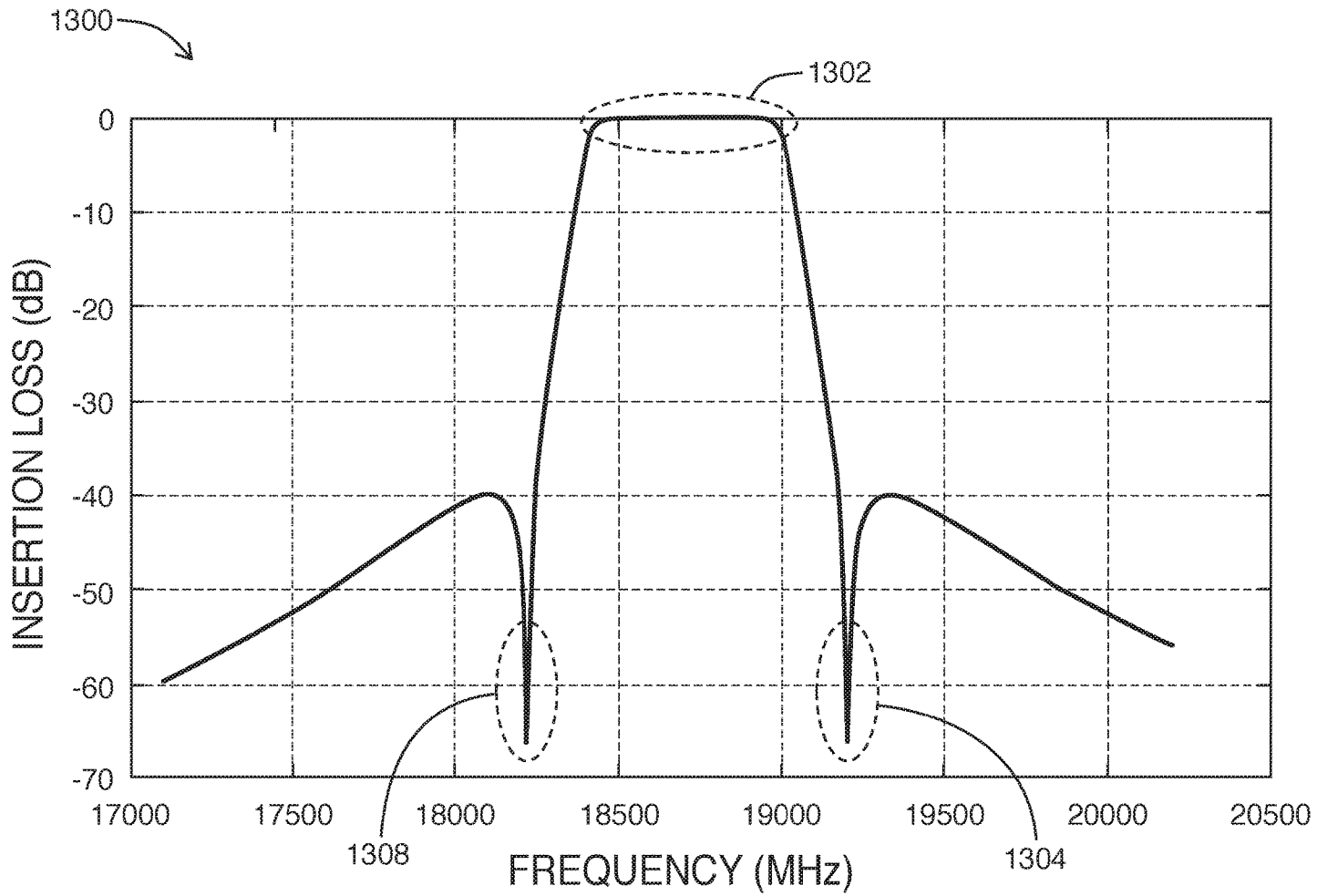
FIG. 13 is a schematic diagram showing one trace of the frequency response of the microwave filter of FIG. 12A.

Referring now to FIG. 13, therein illustrated is a frequency response 1300 of the microwave coaxial filter 1200, the x-axis representing frequencies in MHz and the v-axis representing insertion loss in dB. Signals having frequencies above the passband 1302 that arrive at the third resonator 1230 propagating over the path of R1-R2-R3 are out of phase with signals having frequencies above the passband that arrive at the third resonator 1230 propagating over the path R1-R3. As a result, a transmission zero 1304 is formed in an upper stop band at frequencies above the passband 1302. The location of the transmission zero in the stopband can be adjusted using one or more of tuning screws, decoupling walls, resonator adjustments or other mechanisms according to techniques known in the art.

Continuing with reference to FIG. 13, signals having frequencies below the passband that arrive at the fifth resonator 1250 over the path R3-R4-R5 are out of phase with signals having frequencies below the passband that arrive at the fifth resonator 1250 over the path R3-R5. This cross coupling behavior is due to the elongated shape of the elongated fourth resonator 1240. A transmission zero 1308 is formed in a lower stop band at frequencies below the passband 1302. The location of the transmission zero in the stopband can be adjusted using one or more of tuning screws, decoupling walls, adjustments of the third resonator 1230 and the fifth resonator 1250 or other mechanisms according to techniques known in the art. The presence of a transmission zero 1304 in the upper stopband and a transmission zero 1308 in the lower stopband provides the microwave filter 1200 with a bandpass behavior. It will be appreciated that the bandpass behavior is achieved using the microwave filter 1200 having the elongated fourth resonator 1240 without use of a cross-coupling probe. In particular, a cross-coupling probe is not used to cross-couple the fourth resonator 1240 with the fifth resonator 1250.

The location of the transmission zero 1308 in the lower stopband can be further adjusted by varying the length of the elongated fourth resonator 1240. Advantageously, since the microwave filter 1200 with elongated fourth resonator 1240 is free of a cross-coupling probe for at least one of the cross-coupling of two resonators, tuning of the microwave filter 1200 can be achieved. For example, tuning can be achieved using tuning screws that can be accessed from outside of the filter housing 1202. This tuning approach can be achieved more easily and at lower cost. Furthermore, performance of the microwave filter 1200 is significantly improved due to the absence of a cross-coupling probe. According to some exemplary embodiments, the entire bandpass microwave filter 1200 can be implemented without use of a cross-coupling probe.

It will be appreciated that the microwave filter 1200 is formed by cascading a low-pass microwave filter 100 with the microwave filter 700 having an elongated resonator 720, wherein the third resonator 1230 is shared in the cascaded arrangement. According to various exemplary embodiments, any number of low-pass microwave filters 100 can be cascaded with any number of microwave filters 700 having the elongated resonator 730 in order to form a microwave filter assembly with a desired number of transmission zeros in the lower stopband and a desired number of transmission zeros in the upper stopband. A low-pass microwave filter 100 can be introduced in order to form a transmission zero in the upper stopband. A microwave filter 700 having an elongated resonator 730 can be introduced in order to form a transmission zero in the lower stopband. It will be appreciated that a microwave filter assembly formed by cascading one or more low-pass microwave filters 100 described herein and one or more high-pass microwave filters 700 having an elongated third resonator 730 described herein can be implemented to be free of cross-coupling probes for cross-coupling two resonators of the microwave filter assembly.

Figure 14:
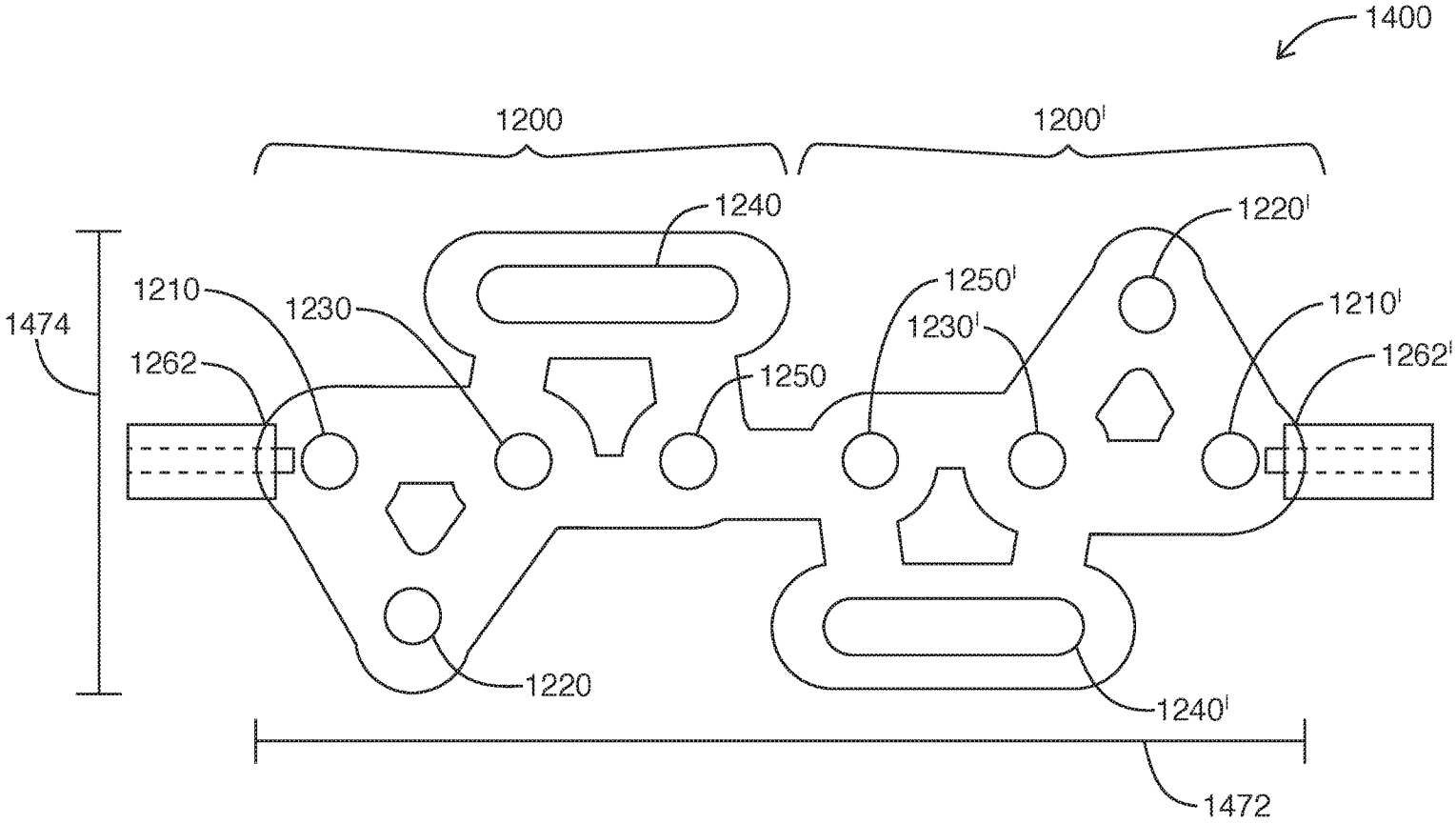
FIG. 14 is a plan view of a 10-pole microwave filter having an elongated resonator according to one exemplary embodiment.

Referring now to FIG. 14, therein illustrated is a plan view of a bandpass microwave coaxial filter assembly 1400 having four transmission zeros according to various exemplary embodiments. Bandpass microwave coaxial filter assembly 1400 is formed by cascading two bandpass microwave coaxial filters. A first bandpass microwave coaxial filter 1200 and a second inverted bandpass microwave coaxial filter 1200' are cascaded. The fifth resonator 1250 of the first bandpass filter 1200 is electromagnetically coupled to the fifth resonator 1250' of the second bandpass filter 1200'. The second bandpass microwave coaxial filter 1200' is inverted in that the input port 1262' acts as the output port. Signals propagate through the second bandpass microwave coaxial filter 1200' from the fifth resonator 1250' to the first resonator 1210' and is outputted at port 1262'. For example, an input port 1262 of the first bandpass microwave coaxial filter 1200 acts as the input for the microwave filter assembly 1400. The exemplary microwave bandpass filter assembly includes ten poles and four cross couplings.

Figure 15:
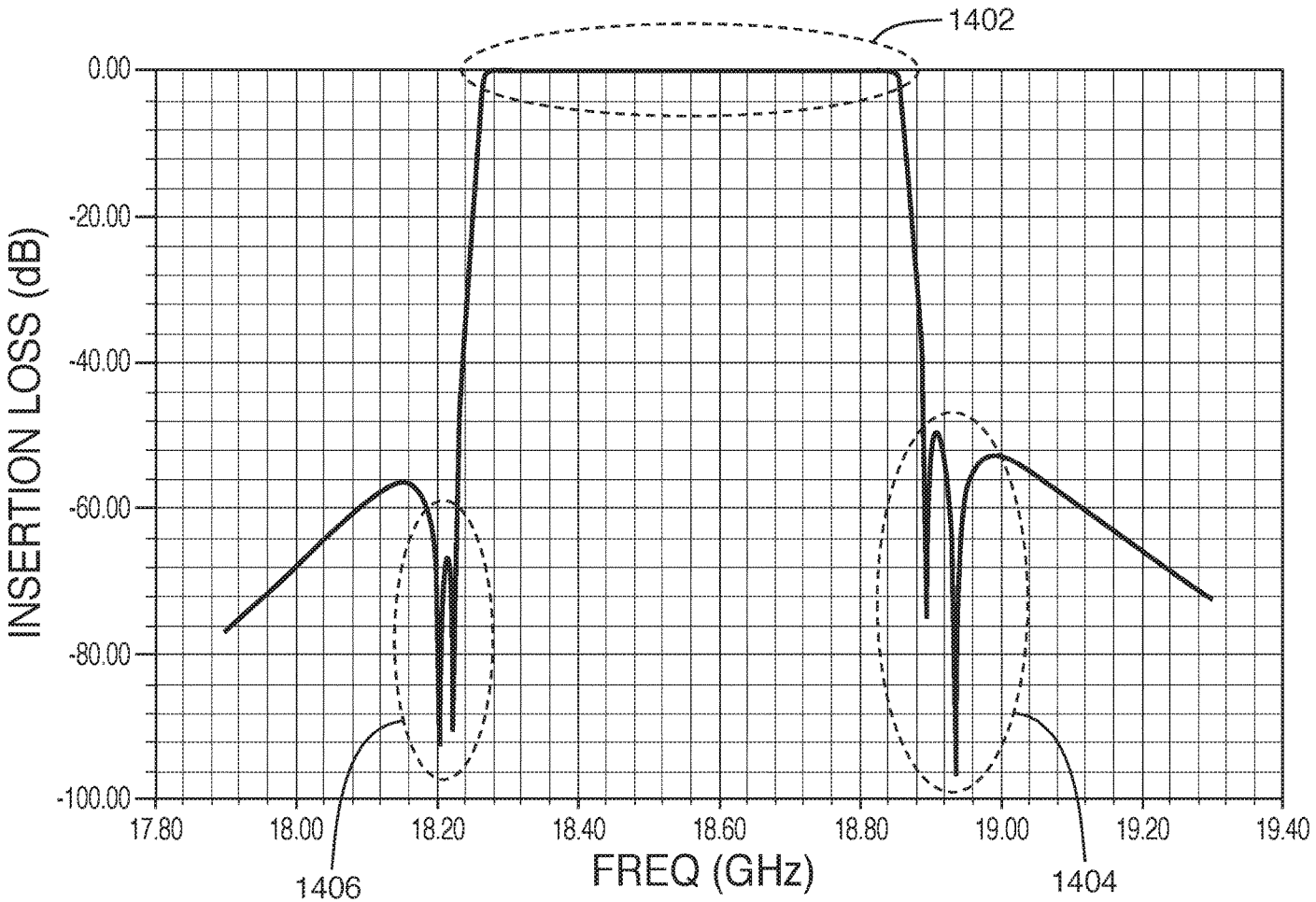
FIG. 15 is schematic diagram showing one trace of the frequency response of the microwave filter of FIG. 14.

Reference is now made to FIG. 14 and FIG. 15 simultaneously, FIG. 15 illustrating a frequency response of the microwave coaxial filter assembly 1400, the x-axis representing frequencies in GHz and the v-axis representing insertion loss in dB. Returning to FIG. 14, signals arrive at the third resonator 1230 by propagating over either a first path formed of first resonator 1210 to second resonator 1220 to third resonator 1230 (R1-R2-R3) or over a second path formed of first resonator 1210 to third resonator 1230 (R1-R3). Signals having frequencies above the passband that arrive at the third resonator 1230 over the first path R1-R2-R3 are out of phase with signals having frequencies above the passband that arrive at the third resonator 1230 over the second path R1-R3. A first high-side transmission zero 1404 is formed in an upper stop band at frequencies above the passband 1402 as shown in FIG. 15.

Returning to FIG. 14, signals arrive at the fifth resonator 1250 by propagating over either a first path formed of third resonator 1230 to elongated fourth resonator 1240 to fifth resonator 1250 (R3-R4-R5) or a second path formed of third resonator 1230 to fifth resonator 1250 (R3-R5). Signals having frequencies below the pass band that arrive at the fifth resonator 1250 over the first path R3-R4-R5 are out of phase with signals having frequencies below the passband that arrive at the fifth resonator 1250 over the second path R3-R5. This cross-coupling behavior is caused by the presence of the elongated resonator 1240. A first low-side transmission zero 1406 is formed in a lower stop band at frequencies below the passband 1402 as shown in FIG. 15.

Returning to FIG. 14, signals arrive at the third resonator 1230' of the second filter 1200' by propagating over either a first path formed of fifth resonator 1250' to elongated fourth resonator 1240' to third resonator 1230' (R5'-R4'-R3') or over a second path formed of fifth resonator 1250' to third resonator 1230' (R5'-R3'). Signals having frequencies below the pass band that arrive at the third resonator 1230' over the first path R5'-R4'-R3' are out of phase with signals having frequencies below the passband that arrive at the third resonator 1230' over the second path R5'-R3'. This cross-coupling behavior is caused by the presence of the elongated resonator 1240'. A second low-side transmission zero 1406 is formed in the lower stop band at frequencies below the passband as shown in FIG. 15.

Returning to FIG. 14, signals arrive at the first resonator 1210' of the second filter 1200' by propagating over either a first path formed of third resonator 1230' to second resonator 1220' to first resonator 1210' (R3'-R2'-R1') or a second path formed of third resonator 1230' to first resonator 1210' (R3'-R1'). Signals having frequencies above the passband that arrive at the first resonator 1210' over the first path R3'-R2'-R1' are out of phase with signals having frequencies above the passband that arrive at the first resonator 1210' over the second path R3'-R1'. Second high-side transmission zero 1404 is formed in the upper stop band at frequencies above the pass band 1402 as shown in FIG. 15. As a result, the bandpass microwave filter assembly 1400 has a frequency response having two transmission zeros 1406 in the lower stop band and two transmission zeros 1404 in the upper stop band as shown in FIG. 15.

The location of the transmission zeros in the stopband can be adjusted using one or more of tuning screws, decoupling walls, adjustments of the resonators or other mechanisms according to techniques known in the art. The location of the transmission zeros located in the lower stop band can be further adjusted by varying the length of the elongated fourth resonator 1240 of the first microwave filter 1200 and/or the length of the elongated fourth resonator 1240' of the second microwave filter 1200'.

Figure 16:
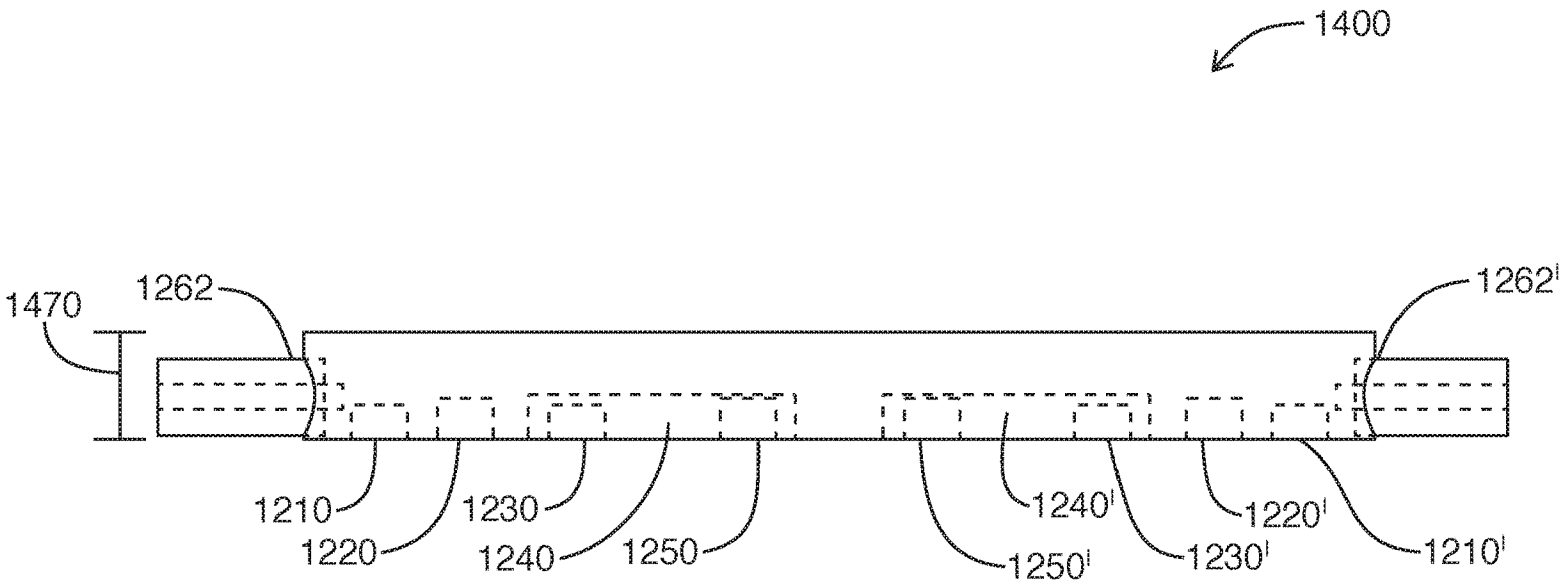
FIG. 16 is a side view of the 10-pole microwave filter of FIG. 14 according to one exemplary embodiment.

The microwave coaxial filters described according to various exemplary embodiments provide a savings in space over an equivalent waveguide filter. Referring now to FIG. 16, therein illustrated is an elevation side view of the bandpass microwave coaxial filter assembly 1400 shown in FIG. 14. As described above, the bandpass microwave coaxial filter assembly 1400 has an input port 1262, first resonator 1210, second resonator 1220, third resonator 1230, fourth resonator 1240, and fifth resonator 1250 of a first bandpass microwave coaxial filter and an input port 1262', first resonator 1210', second resonator 1220', third resonator 1230', fourth resonator 1240', and fifth resonator 1250' of a second bandpass microwave coaxial filter. The bandpass microwave coaxial filter assembly 1400 can be implemented to have an internal height 1470 of approximately 0.22 inches. Referring back to FIG. 14, the bandpass microwave coaxial filter assembly 1400 can be implemented to have an internal length 1472 of approximately 2.33 inches and an internal width 1474 of approximately 1.03 inches. By contrast, a typical equivalent waveguide filter would have a length of approximately 3.80 inches and a height of 1.10 inches.

According to various exemplary embodiments, the filter function can be slightly pre-distorted in order to improve the shape of the return loss and obtain a better equivalent Quality Factor. For example, the filter function can be pre-distorted by having 10 to 15 dB return loss. The pre-distortion of the filter function provides improved in-band flatness without having to increase the size of the filter.

Various exemplary embodiments of microwave coaxial filters described herein can be implemented to achieve a Quality Factor of approximately 3000. Accordingly, the microwave coaxial filters having at least one elongated resonator can be suitable for use as Ka-band filters. For example, the microwave coaxial filters having at least one elongated resonator can be suitable where only wideband filters are required. Advantageously, in being free of cross-coupling probes for at least one of the cross-coupling of two resonators, the microwave coaxial filters having at least one elongated resonator can be manufactured at a lower cost and with more easily.

Figure 17:
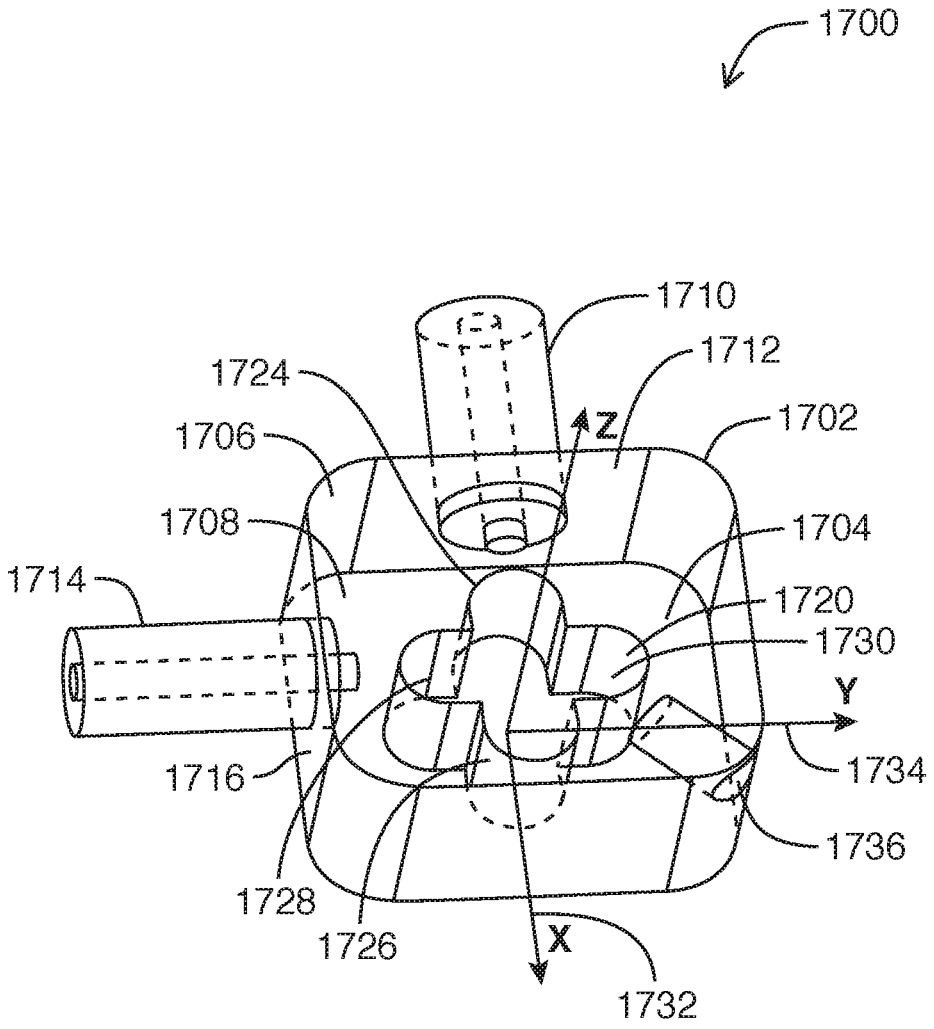
FIG. 17, is a perspective view of a microwave filter having a dual-mode resonator according to one exemplary embodiment.
Figure 18:
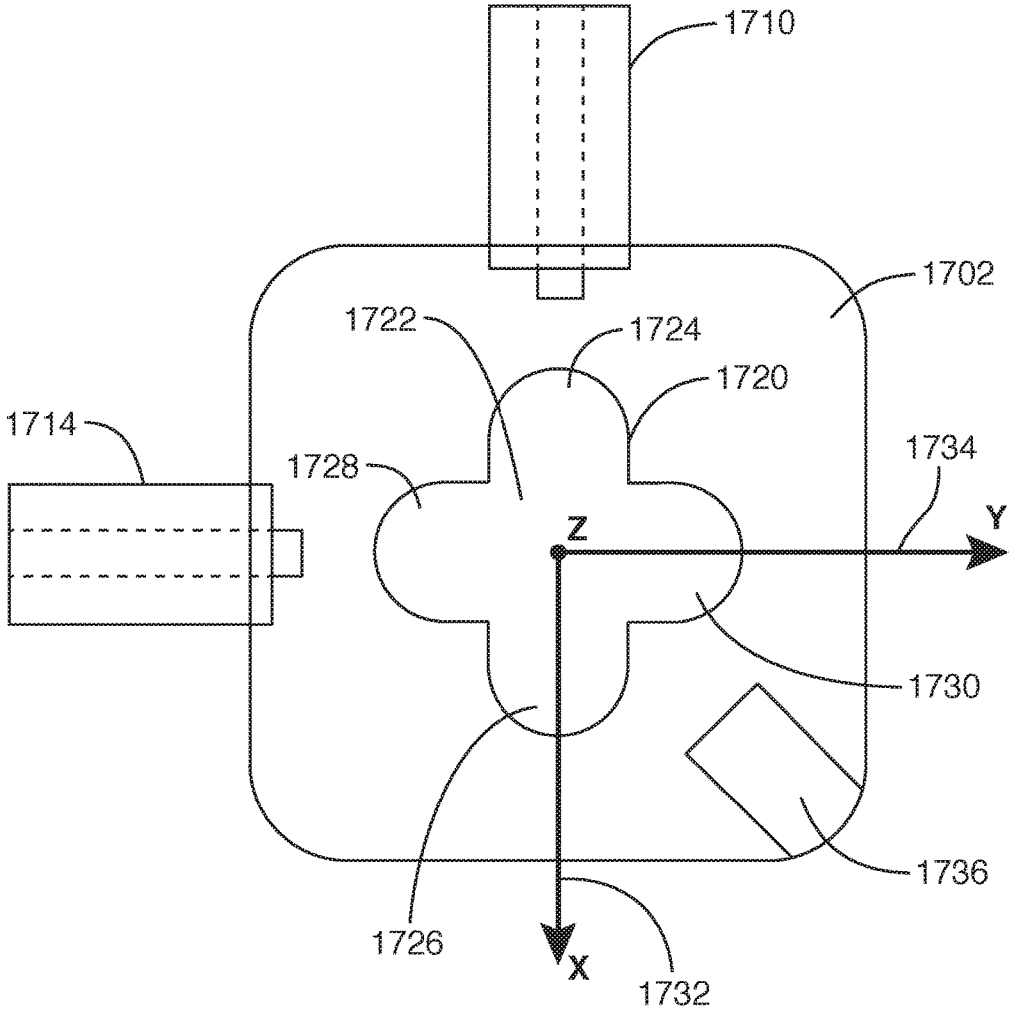
FIG. 18 is a plan view of the microwave filter of FIG. 17.

Referring now to FIGS. 17 and 18, therein illustrated is a perspective view and plan view, respectively of a microwave filter 1700 (FIG. 17) according to various exemplary embodiments. The microwave filter 1700 (FIG. 17) has a housing 1702 defining an inner cavity 1704 (FIG. 17). The housing 1702 has housing walls 1706 and a housing floor 1708 as shown in FIG. 17. According to some exemplary embodiments, the housing 1702 can further have one or more removable lids (not shown). For example, the removable lid can be placed opposite the housing floor 1708 to seal the inner cavity 1704. Alternatively, a housing ceiling (not shown) positioned opposite the housing floor 1708 seals the inner cavity 1704 (FIG. 17). The housing 1702 can be made of a suitable metal such as aluminum or copper. However, the housing 1702 can be formed of other suitable materials such that electromagnetic signals are contained within the inner cavity 1704 inside the housing 1702. Although the housing 1702 is typically translucent, for ease of explanation, the housing 1702 is shown in FIG. 17 as being transparent.

A first input 1710 is provided in a first subwall 1712 (FIG. 17) of housing walls 1706. Electromagnetic energy can be radiated via the first input 1710 into the inner cavity 1704 (FIG. 17). A second input 1714 is provided in a second subwall 1716 (FIG. 17) of housing walls 1706. Electromagnetic energy can also be radiated via the second input 1714 into the inner cavity 1704.

The electromagnetic energy radiated into the inner cavity 1704 via the first input 1710 can resonate as a first resonant mode in the inner cavity 1704. The electromagnetic energy radiated into the inner cavity 1704 via the second input 1714 can resonate as a second resonant mode that is orthogonal to the first resonant mode. Accordingly, the first resonant mode and the second resonant mode can resonate simultaneously within the inner cavity 1704 without substantially interfering with one another.

A dual-mode resonator 1720 is positioned in the inner cavity 1704. For example, the resonator 1720 can be attached to the housing floor 1708. The dual mode resonator 1720 has a body portion 1722 (FIG. 18) and four laterally extending members, 1724, 1726, 1728, and 1730.

The first member 1724 and second member 1726 extend laterally from the central body 1722 opposite from each other. The directions of the extension of the first and second members 1724 and 1726 define a first axis 1732, designated as an X-axis.

Third member 1730 and fourth member 1728 each extend laterally from the central body 1722 opposite from each other. The directions of the extension of the third and fourth members 1730 and 1728 define a second axis 1734, designated as a Y-axis that is orthogonal to the first axis 1732. As shown in FIGS. 17 and 18, a third axis that is orthogonal to the first axis 1732 and orthogonal to the second axis 1734 may be designated as a Z-axis.

The first and second resonant modes can simultaneously resonate within the dual-mode resonator 1720. For example, the first axis 1732 of the dual-mode resonator 1720 can be aligned with the input port 1710 and the second axis 1734 can be aligned with the second input port 1714.

It will be appreciated that the dual-mode resonator 1720 acts as two elongated resonators being positioned orthogonally within the inner cavity 1704. Advantageously, the two resonant modes can be generated individually. Furthermore, the coupling between the two resonant modes can be optimized individually. Moreover, the space required to implement the dual-mode resonator 1720 is substantially less than the space that would be required by using two separate elongated resonators. For example, the space required by the dual-mode resonator 1720 can be half of that required by two separate resonators.

According to various exemplary embodiments, a coupling element 1736 can be provided in the housing wall 1702 to couple the first resonant mode of the dual-mode resonator 1720 with the second resonant mode of the dual-mode resonator 1720. For example, the coupling element 1736 can be a coupling screw. The coupling element 1736 is oriented at a non-zero angle relative to axes 1732 and 1734. For example, the coupler is oriented at a 45 degree angle in relation to axis 1732 defined by the first and second members 1724 and 1726 and to axis 1734 defined by the third and fourth members 1728 and 1730.

Figure 12B:
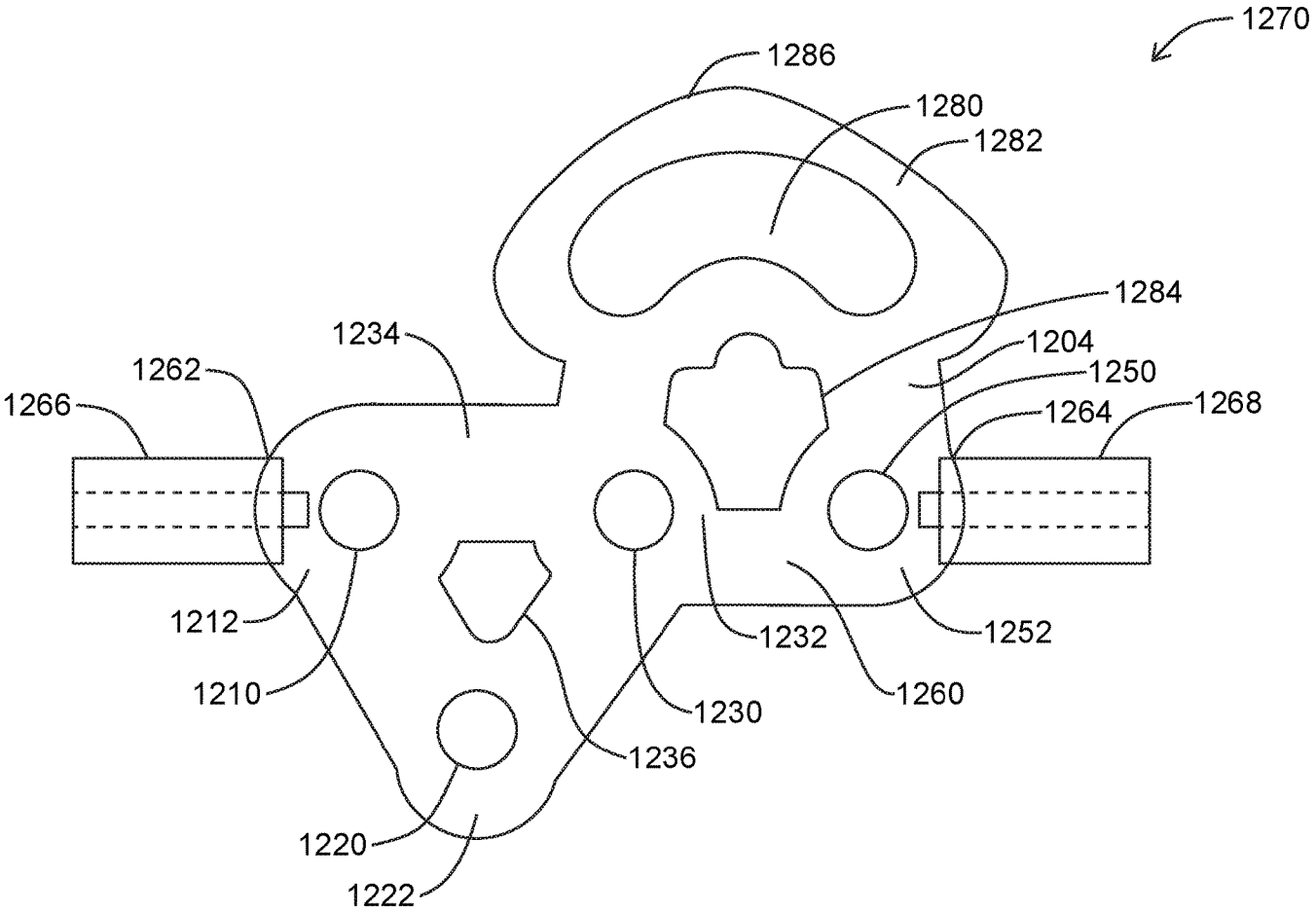
FIG. 12B is a plan view of 5-pole microwave filter having a curvedly elongated resonator according to one exemplary embodiment.

Referring now to FIG. 12B, therein illustrated is a microwave coaxial filter 1270 having a bandpass frequency response according to various exemplary embodiments. Reference numerals may be repeated from FIG. 12A to indicate corresponding or analogous elements. The microwave coaxial filter 1270 has a housing 1286 defining an inner cavity 1204. A fourth resonator 1280 is positioned in a fourth portion 1282 of the inner cavity 1204. The fourth resonator 1280 can be fixed to the housing floor. The fourth resonator 1280 is elongated and curved, similar to the second resonator 720 as disclosed in FIG. 11. The housing 1286 can have second inner walls 1284 positioned within the geometric shape defined by the positions of the resonators 1230, 1280 and 1250. The second inner walls 1284 provide a separation between the resonators and with the housing 1286. The second inner walls 1284 and the housing 1286 together define the fourth portion 1282, fifth portion 1252 and sixth portion 1232 of the cavity 1204 as shown in FIG. 12A. The second inner walls 1284 can further define with the housing 1286 channels of the inner cavity 1204 providing fluid communication between the third resonator 1230, fourth resonator 1280 and/or the fifth resonator 1250.

While the above description provides examples of the embodiments, it will be appreciated that some features and/or functions of the described embodiments are susceptible to modification without departing from the spirit and principles of operation of the described embodiments. Accordingly, what has been described above has been intended to be illustrative of the invention and non-limiting and it will be understood by persons skilled in the art that other variants and modifications may be made without departing from the scope of the invention as defined in the claims appended hereto.

The invention claimed is:

1. A microwave filter comprising:

a housing defining an inner cavity;

a first resonator positioned in a first portion of the inner cavity;

a third resonator positioned in a third portion of the inner cavity and being cross-coupled with the first resonator;

a second resonator positioned in a second portion of the inner cavity, the second resonator being coupled to the first resonator and the third resonator;

a fifth resonator positioned in a fifth portion of the inner cavity and being cross-coupled to the third resonator; and a fourth resonator positioned in a fourth portion of the inner cavity, the fourth resonator being elongated and being coupled with the third resonator and the fifth resonator, wherein an electric field at a first end of the elongated fourth resonator is out of phase with an electric field at a second end of the elongated fourth resonator.

2. The microwave filter of claim 1, wherein the elongated fourth resonator is adjacent the third resonator and the fifth resonator, and wherein the fifth resonator is non-adjacent the third resonator.

3. The microwave filter of claim 1, wherein the third resonator and the fifth resonator are cross-coupled via an iris connecting the third portion and the fifth portion of the inner cavity.

4. The microwave filter of claim 1, wherein the third resonator and the fifth resonator are cross-coupled free of a cross-coupling probe and wherein the first resonator and the third resonator are cross-coupled free of a cross-coupling probe.

5. The microwave filter of claim 1, wherein the elongated fourth resonator is elongated in a direction of a magnetic field of electromagnetic signals propagating within the microwave filter.

6. The microwave filter of claim 1, wherein the elongated fourth resonator is one of: linearly elongated and curvedly elongated.

7. The microwave filter of claim 1, wherein a cross-coupling between the third resonator and the fifth resonator is dominantly inductive and wherein a coupling between the third resonator and the elongated fourth resonator is dominantly inductive and a coupling between the elongated fourth resonator and the fifth resonator is dominantly inductive.

8. The microwave filter of claim 1, wherein the microwave filter has a frequency response comprising a passband, a lower stopband, a higher stopband, and at least one transmission zero in the lower stopband and at least one transmission zero in the higher stopband.

9. A microwave filter assembly comprising at least a first microwave filter and a second microwave filter according to claim 1.

10. The microwave filter assembly of claim 9, wherein the microwave filter assembly has a frequency response comprising a passband, a lower stopband, a higher stopband, and at least one transmission zero in the lower stopband and at least one transmission zero in the higher stopband.

11. The microwave filter assembly of claim 10, wherein the frequency response has at least two transmission zeros in the lower stopband and at least two transmission zeros in the higher stopband.

12. The microwave filter assembly of claim 9, wherein a filter function of the microwave filter assembly is predistorted.

* * * * *